US009096997B2

(12) United States Patent
Mochita et al.

(10) Patent No.: US 9,096,997 B2
(45) Date of Patent: Aug. 4, 2015

(54) SANITARY WASHING APPARATUS

(75) Inventors: Masayuki Mochita, Fukuoka-ken (JP); Takeshi Yamakawa, Fukuoka-ken (JP); Nobutake Sakumoto, Fukuoka-ken (JP); Jun Kawamata, Fukuoka-ken (JP); Mayako Adachi, Fukuoka-ken (JP); Aiko Sato, Fukuoka-ken (JP); Yosuke Inoue, Fukuoka-ken (JP); Nanae Yamada, Fukuoka-ken (JP)

(73) Assignee: TOTO LTD., Kitakyushu-Shi (JP)

( * ) Notice: Subject to any disclaimer, the term of this patent is extended or adjusted under 35 U.S.C. 154(b) by 936 days.

(21) Appl. No.: 13/294,257

(22) Filed: Nov. 11, 2011

(65) Prior Publication Data

US 2012/0117722 A1 May 17, 2012

(30) Foreign Application Priority Data

| | | |
|---|---|---|
| Nov. 15, 2010 | (JP) | 2010-254924 |
| Nov. 15, 2010 | (JP) | 2010-254925 |
| Nov. 15, 2010 | (JP) | 2010-254926 |
| Sep. 28, 2011 | (JP) | 2011-212348 |

(51) Int. Cl.
*A47K 3/20* (2006.01)
*E03D 9/08* (2006.01)

(52) U.S. Cl.
CPC ..... *E03D 9/08* (2013.01)

(58) Field of Classification Search
CPC ..... E03D 9/08
USPC ..... 4/443–449
See application file for complete search history.

(56) References Cited

U.S. PATENT DOCUMENTS 6,754,912 B1 6/2004 Hayashi

FOREIGN PATENT DOCUMENTS

| | | | |
|---|---|---|---|
| JP | 59-199932 | A | 11/1984 |
| JP | 64-029532 | A | 1/1989 |
| JP | 1-138975 | U | 9/1989 |
| JP | 2003-286738 | A | 10/2003 |
| JP | 2006-249671 | A | 9/2006 |
| JP | 2009-138447 | A | 6/2009 |
| TW | I-332538 | B | 11/2010 |

OTHER PUBLICATIONS

Office Action issued in Taiwan Application No. 100141662 dated Jan. 23, 2014.
Office Action issued in Japanese Patent Application No. 2011-212348 dated Feb. 21, 2014.

*Primary Examiner* — Lori Baker
(74) *Attorney, Agent, or Firm* — Pearne & Gordon LLP

(57) ABSTRACT

A sanitary washing apparatus is provided according to one aspect of the invention, where the sanitary washing apparatus includes: a washing nozzle having a water discharge port, where the washing nozzle is configured to wash a body of a user by squirting water from the water discharge port; and a casing capable of storing the washing nozzle. The washing nozzle is configured to change from a stored state to an advanced state while transitioning to an orientation having a greater angle of an axis of the washing nozzle with respect to a horizontal plane, where the washing nozzle is stored in the casing in the stored state, and the washing nozzle is configured to wash the body in the advanced state.

23 Claims, 12 Drawing Sheets

SANITARY WASHING APPARATUS

CROSS-REFERENCE TO RELATED APPLICATIONS

This application is based upon and claims the benefit of priorities from the prior Japanese Patent Application No. 2010-254924, filed on Nov. 15, 2010, the prior Japanese Patent Application No. 2010-254925, filed on Nov. 15, 2010, the prior Japanese Patent Application No. 2010-254926, filed on Nov. 15, 2010, and the prior Japanese Patent Application No. 2011-212348, filed on Sep. 28, 2011; the entire contents of which are incorporated herein by reference.

FIELD

Aspects of the invention generally relate to a sanitary washing apparatus, and more specifically, to a sanitary washing apparatus configured to use water to wash a bottom and the like of a user sitting on a western-style sit-down toilet.

BACKGROUND

In a sanitary washing apparatus, a washing nozzle configured to wash the body, e.g., the bottom and the like, of a user sitting on a toilet seat, a drive unit configured to drive the washing nozzle, etc., are stored inside, for example, a casing. Then, the washing nozzle advances from the casing into the bowl of the toilet by moving linearly at the angle of the stored state when squirting the water onto the bottom and the like of the user. Generally, the washing nozzle is stored inside the casing at a prescribed angle that is the same as the angle when advancing such that the washing nozzle does not contact the rear of the user when advancing into the bowl of the toilet. Due to design improvements of the toilet space in recent years, it is desirable for the sanitary washing apparatus to be more compact.

For example, there is a human private part washing apparatus that can change the angle of the washing nozzle (JP-A 2006-249671 (Kokai)). In the human private part washing apparatus recited in JP-A 2006-249671 (Kokai), the washing nozzle moves linearly as viewed from a cylinder. The cylinder is provided rotatably as viewed from a base member. However, the cylinder exists on the base member regardless of whether the washing nozzle is in the advanced state, which is the state of use, or in the stored state. Therefore, even if the angle of the washing nozzle can be changed, a space for the cylinder to rotate on the base member, and in particular, a space above the casing, is necessary. Even if the angles of the cylinder and the washing nozzle with respect to the base member are small when the washing nozzle is in the stored state, it is necessary for these angles to be not less than an angle such that the washing nozzle does not contact the rear of the user when the washing nozzle advances. Therefore, problems remain to provide a more compact human private part washing apparatus with a low storage height of the washing nozzle.

Also, there is a human body drying apparatus in which a nozzle drive unit controls such that a drying nozzle at a retracted position has a tilted orientation in which a tip that has an outlet faces downward and the position of the outlet at the advanced position of the drying nozzle is positioned higher than the position of the outlet if the drying nozzle were advanced in the longitudinal direction as-is at the tilted orientation (JP-A 2003-286738 (Kokai)). In the human body drying apparatus recited in JP-A 2003-286738 (Kokai), the tilt of the drying nozzle changes as the drying nozzle advances. However, there is a risk that the drive force transmitted from the drive unit to the drying nozzle may change as the tilt angle of the drying nozzle changes because the drive unit is positioned inside the main body case and is linked to the motor by a shaft. In such a case, there is a risk that the drying nozzle cannot advance with a constant advancement amount and cannot advance stably. Thereby, there is a risk that, for example, the position of the drying nozzle may shift from the desired position even in the case where the user adjusts the position of the drying nozzle. Further, in the human body drying apparatus recited in JP-A 2003-286738 (Kokai), the drying nozzle is in more of an upright state when at the retracted position than when at the advanced position. Therefore, problems remain to provide a more compact human body drying apparatus with a low retracted height of the drying nozzle.

SUMMARY

A sanitary washing apparatus is provided according to one aspect of the invention, where the sanitary washing apparatus includes: a washing nozzle having a water discharge port, where the washing nozzle is configured to wash a body of a user by squirting water from the water discharge port; and a casing capable of storing the washing nozzle. The washing nozzle is configured to change from a stored state to an advanced state while transitioning to an orientation having a greater angle of an axis of the washing nozzle with respect to a horizontal plane, where the washing nozzle is stored in the casing in the stored state, and the washing nozzle is configured to wash the body in the advanced state.

DETAILED DESCRIPTION

Figure 1:
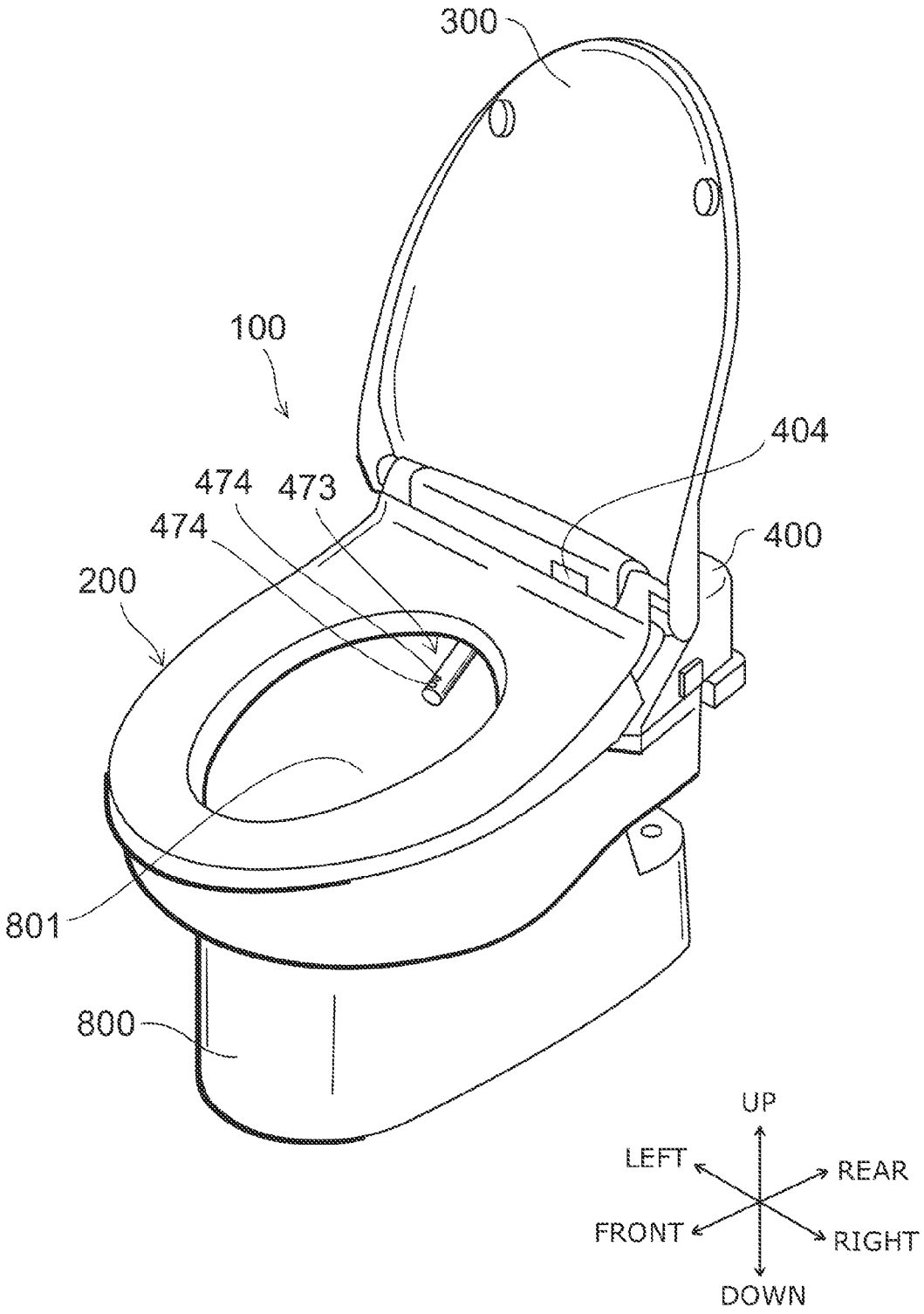
FIG. 1 is a schematic perspective view illustrating a toilet apparatus including a sanitary washing apparatus according to an embodiment of the invention.

The first invention is a sanitary washing apparatus, including: a washing nozzle having a water discharge port, the washing nozzle being configured to wash a body of a user by squirting water from the water discharge port; and a casing capable of storing the washing nozzle, the washing nozzle being configured to change from a stored state to an advanced state while transitioning to an orientation having a greater angle of an axis of the washing nozzle with respect to a horizontal plane, the washing nozzle being stored in the casing in the stored state, the washing nozzle being configured to wash the body in the advanced state.

According to this sanitary washing apparatus, the washing nozzle changes from the stored state to the advanced state while transitioning to the orientation having the greater angle of the axis of the washing nozzle with respect to the horizontal plane. Therefore, the washing nozzle can be stored at an orientation at which the angle of the axis of the washing nozzle with respect to the horizontal plane is smaller than that of the advanced state; and the rotation space necessary to change the angle can be minimized by the washing nozzle advancing while the angle transitions. Thereby, the height of the washing nozzle in the stored state can be lower. Therefore, the height of the sanitary washing apparatus can be lower; and a compact sanitary washing apparatus can be realized.

The second invention is the sanitary washing apparatus according to the first invention, wherein: the angle of the stored state is an angle configured to cause the washing nozzle to contact a rear of the user in the case where the washing nozzle advances at the angle of the stored state from a position of the stored state; and the washing nozzle is capable of avoiding contact with the rear of the user by advancing while transitioning to the orientation having the greater angle.

According to this sanitary washing apparatus, the washing nozzle is capable of avoiding contact with the rear of the user by advancing while transitioning to the orientation having the greater angle of the axis of the washing nozzle with respect to the horizontal plane. Therefore, the washing nozzle can be stored at an orientation having an angle of the axis of the washing nozzle with respect to the horizontal plane that is small enough that the washing nozzle would contact the rear of the user if the washing nozzle advanced as-is at the orientation (the angle) of the stored state. Thereby, the contact of the washing nozzle in the advanced state with the rear of the user can be avoided even in the case where the height of the washing nozzle in the stored state is low. Thereby, the height of the washing nozzle in the stored state can be lower. Therefore, the height of the sanitary washing apparatus can be lower; and a compact sanitary washing apparatus can be realized.

The third invention is the sanitary washing apparatus according to the second invention, wherein a path traced by a tip of the washing nozzle includes: a curved path to cause the washing nozzle to avoid contacting the rear of the user; and a straight-line path to cause the washing nozzle to reach the advanced state.

According to this sanitary washing apparatus, a straight-line path when the washing nozzle changes from the stored state to the advanced state corresponds to the final portion of the path of the tip of the washing nozzle. In other words, the tip of the washing nozzle traces a straight-line path after a curved path. Therefore, for example, the discharge range of the wash water squirted from the washing nozzle does not change even in the case where a function (a moving function) is used in which the user can adjust the position of the washing nozzle. Therefore, the washing sensation due to the wash water squirted from the washing nozzle can be stabilized.

The fourth invention is the sanitary washing apparatus according to the second invention, wherein a path traced by a tip of the washing nozzle includes: a straight-line path to cause the washing nozzle to advance to approach the rear of the user; and a curved path to cause the washing nozzle to avoid contacting the rear of the user and reach the advanced state.

According to this sanitary washing apparatus, the tip of the washing nozzle traces the curved path after tracing the straight-line path. Therefore, the distance between the casing and the rear end portion of the washing nozzle when the tip of the washing nozzle traces the curved path is longer than that of the case where the tip of the washing nozzle traces the curved path prior to tracing the straight-line path. Therefore, the tip of the washing nozzle can trace a longer curved path. Thereby, the height of the washing nozzle in the stored state can be even lower. Therefore, the height of the sanitary washing apparatus can be even lower; and a more compact sanitary washing apparatus can be realized.

The fifth invention is the sanitary washing apparatus according to the third invention, wherein a length of the straight-line path is longer than a length of the curved path.

According to this sanitary washing apparatus, contact of the washing nozzle with the rear of the user can be avoided in the straight-line path that is longer than the curved path. Therefore, a wider washing range can be ensured. Thereby, the moving function can be executed while stabilizing the washing sensation over a wider range.

In the case where the tip of the washing nozzle traces the curved path after tracing the straight-line path, a longer distance between the casing and the rear end portion of the washing nozzle can be ensured by the straight-line path being traced. Therefore, a larger space can be ensured when the tip of the washing nozzle traces the curved path. Therefore, the height of the sanitary washing apparatus can be even lower; and a more compact sanitary washing apparatus can be realized.

The sixth invention is the sanitary washing apparatus according to the first invention, further including a path guide configured to guide the movement of the washing nozzle, the washing nozzle changing from the stored state to the advanced state while tracing a constant path due to the path guide.

According to this sanitary washing apparatus, the path of the washing nozzle is regulated by the path guide. Therefore, the washing nozzle changes from the stored state to the advanced state while tracing substantially the same path each time. Thereby, the movement of the washing nozzle and the reliability of the sanitary washing apparatus can be improved further.

The seventh invention is the sanitary washing apparatus according to the sixth invention, wherein the path guide includes an angle regulator configured to regulate an angle of a straight-line path with respect to the horizontal plane, the straight-line path causing the washing nozzle to reach the advanced state.

The eighth invention is the sanitary washing apparatus according to the sixth invention, wherein the path guide includes an angle regulator configured to regulate an angle of a straight-line path with respect to the horizontal plane, the straight-line path causing the washing nozzle to advance to approach the rear of the user.

According to this sanitary washing apparatus, the angle of the straight-line path with respect to the horizontal plane is regulated by an angle regulator. Therefore, the angle of the straight-line path with respect to the horizontal plane does not change with each movement of the washing nozzle. Therefore, it is unnecessary to adjust the washing nozzle to the preferred position each time the user uses the sanitary washing apparatus. Thereby, the ease of use of the sanitary washing apparatus can be even better.

The ninth invention is the sanitary washing apparatus according to the seventh invention, wherein: the path guide includes a path groove configured to regulate the path of the washing nozzle; and the washing nozzle includes an engaging portion capable of engaging the path groove, and the washing nozzle moves in the constant path by the engaging portion moving while sliding in the path groove.

According to this sanitary washing apparatus, a path groove is made in the path guide; and the washing nozzle includes an engaging portion that is capable of engaging the path groove. The engaging portion engages the path groove. Therefore, shifting of the path of the washing nozzle is suppressed; and the washing nozzle can be caused to stably advance. Thereby, the movement of the washing nozzle and the reliability of the sanitary washing apparatus can be improved further.

The tenth invention is the sanitary washing apparatus according to the ninth invention, wherein: the engaging portion is provided on a rear end portion side of the washing nozzle; and the path guide is disposed and fixed inside the casing.

According to this sanitary washing apparatus, the engaging portion is provided on the rear end portion side of the washing nozzle; and the path guide is disposed and fixed inside the casing. That is, the path guide does not move with the washing nozzle. Therefore, the path of the washing nozzle can be formed using the members and the structures provided in the interior of the casing. Thereby, the height of the washing nozzle in the stored state can be lower with a simpler structure. Therefore, the height of the sanitary washing apparatus can be lower; and a compact sanitary washing apparatus can be realized.

The eleventh invention is the sanitary washing apparatus according to the second invention, wherein the washing nozzle transitions to the orientation having the greater angle by utilizing a space existing above the washing nozzle in the stored state by a forward-advance operation of the washing nozzle when the washing nozzle changes from the stored state to the advanced state.

According to this sanitary washing apparatus, the washing nozzle transitions to the orientation having the greater angle of the axis of the washing nozzle with respect to the horizontal plane by utilizing a space existing above the washing nozzle in the stored state by the forward-advance operation of the washing nozzle when the washing nozzle changes from the stored state to the advanced state. Then, the angle of the axis of the washing nozzle with respect to the horizontal plane in the advanced state in which the washing nozzle is advanced from the casing is larger than the angle of the axis of the washing nozzle with respect to the horizontal plane in the stored state in which the washing nozzle is stored in the casing. Therefore, a special space is unnecessary for the washing nozzle to transition to the orientation having the greater angle of the axis of the washing nozzle with respect to the horizontal plane. Thereby, it is possible to reduce the height of the casing to the maximum height of the washing nozzle in the stored state. Therefore, the height of the sanitary washing apparatus can be lower; and a sanitary washing apparatus that is compact in the height direction can be realized.

The twelfth invention is the sanitary washing apparatus according to the eleventh invention, wherein a movement amount of a tip of the washing nozzle is smaller than a movement amount of a rear end portion of the washing nozzle when the washing nozzle transitions to the orientation having the greater angle.

According to this sanitary washing apparatus, the movement amount of the tip of the washing nozzle is smaller than the movement amount of the rear end portion of the washing nozzle when the washing nozzle transitions to the orientation having the greater angle of the axis of the washing nozzle with respect to the horizontal plane. Therefore, the space where the washing nozzle moves on the front side of the sanitary washing apparatus can be reduced. Therefore, the front portion of the casing positioned proximally to the toilet seat can be lower and may have a smooth configuration along the toilet seat. Thereby, a compact sanitary washing apparatus having better designability can be realized.

The thirteenth invention is the sanitary washing apparatus according to the eleventh invention, further including a rotation shaft configured to guide and regulate the movement of the washing nozzle when the washing nozzle transitions to the orientation having the greater angle, the rotation shaft being provided in the casing.

According to this sanitary washing apparatus, the relative position of the rotation shaft does not change as viewed from the casing because the rotation shaft is provided in the casing. On the other hand, the relative position of the rotation shaft as viewed from the washing nozzle changes between the tip side and the rear end side of the washing nozzle with the movement of the washing nozzle. Then, the angle of the axis of the washing nozzle with respect to the horizontal plane can be changed without moving the rotation shaft with respect to the casing. Therefore, the height of the sanitary washing apparatus can be lower; and a compact sanitary washing apparatus can be realized.

The fourteenth invention is the sanitary washing apparatus according to the thirteenth invention, wherein the rotation shaft is provided on a tip side of the washing nozzle in the stored state.

According to this sanitary washing apparatus, the rotation shaft is provided on the tip side of the washing nozzle in the stored state. Therefore, the movement amount of the tip of the washing nozzle is smaller than the movement amount of the rear end portion of the washing nozzle when the washing nozzle transitions to the orientation having the greater angle of the axis of the washing nozzle with respect to the horizontal plane. Therefore, the space where the washing nozzle moves on the front side of the sanitary washing apparatus can be reduced. Therefore, the front portion of the casing positioned proximally to the toilet seat can be lower and may have a smooth configuration along the toilet seat. Thereby, a compact sanitary washing apparatus having better designability can be realized.

The fifteenth invention is the sanitary washing apparatus according to the eleventh invention, further including a rotation shaft configured to guide and regulate the movement of the washing nozzle when the washing nozzle transitions to the orientation having the greater angle, the rotation shaft being provided in the washing nozzle.

According to this sanitary washing apparatus, the relative position of the rotation shaft as viewed from the washing nozzle does not change because the rotation shaft is provided in the washing nozzle. It is unnecessary to fix the rotation shaft to the casing. Therefore, the structure of the casing can be simpler. Therefore, the height of the sanitary washing apparatus can be lower; and a compact sanitary washing apparatus can be realized.

The sixteenth invention is the sanitary washing apparatus according to the eleventh invention, wherein an upper end portion of the washing nozzle traces a horizontal path parallel to the horizontal plane or a path moving frontward and downward when the washing nozzle transitions to the orientation having the greater angle.

For example, a mechanism and space to change the angle of the washing nozzle become necessary in the front portion of the casing in the case where the washing nozzle transitions to the orientation having the greater angle of the axis of the washing nozzle with respect to the horizontal plane by the tip side of the washing nozzle displacing downward. In such a case, there is a risk that the front portion of the casing cannot be compact.

Conversely, according to this sanitary washing apparatus, the upper end portion of the washing nozzle traces a horizontal path parallel to the horizontal plane or a path that moves frontward and downward when the washing nozzle transitions to the orientation having the greater angle of the axis of the washing nozzle with respect to the horizontal plane. Therefore, the mechanism and the space to change the angle of the washing nozzle can be smaller at the front portion of the casing. Then, the washing nozzle transitions to the orientation having the greater angle of the axis of the washing nozzle with respect to the horizontal plane by utilizing the space existing above the washing nozzle. Therefore, the front portion of the casing positioned proximally to the toilet seat can be lower and may have a smooth configuration along the toilet seat. Thereby, a compact sanitary washing apparatus having better designability can be realized.

The seventeenth invention is the sanitary washing apparatus according to the eleventh invention, further including: a drive unit configured to cause the washing nozzle to advance and retreat from the casing; and a transmission unit configured to transmit a drive force of the drive unit to the washing nozzle, the drive unit being configured to displace in conjunction with the movement of the washing nozzle.

According to this sanitary washing apparatus, the position of the drive unit changes in conjunction with the movement of the washing nozzle even when the washing nozzle transitions to the orientation having the greater angle of the axis of the washing nozzle with respect to the horizontal plane. Therefore, the drive force transmitted from the drive unit to the transmission unit can be maintained at a constant. Alternatively, the relationship between the rotation angle of the drive unit and the advancement amount of the washing nozzle is maintained as linear. Thereby, the washing nozzle can be caused to stably advance. Further, the washing nozzle can be moved accurately to the prescribed position in the case where the user adjusts the position of the washing nozzle.

The eighteenth invention is the sanitary washing apparatus according to the second invention, further including: a drive unit configured to cause the washing nozzle to advance and retreat from the casing; and a transmission unit configured to transmit a drive force of the drive unit to the washing nozzle, a relationship between a push-out amount of the drive unit and an advancement amount of the washing nozzle being linear.

According to this sanitary washing apparatus, the relationship between the push-out amount of the drive unit and the advancement amount of the washing nozzle is maintained as linear even when the washing nozzle changes from the stored state to the advanced state while transitioning to the orientation having the greater angle of the axis of the washing nozzle with respect to the horizontal plane. That is, loss of the drive force transmitted from the drive unit to the transmission unit does not occur due to the washing nozzle advancing while transitioning to the orientation that is more upright than the stored state. Therefore, the washing nozzle can be advanced by a constant drive force transmitted from the drive unit. Thereby, the washing nozzle can be caused to stably advance. Further, the washing nozzle can be moved accurately to the prescribed position in the case where the user adjusts the position of the washing nozzle. Herein, linear means that the relationship between the push-out amount of the drive unit and the advancement amount of the washing nozzle is expressed by a first order equation.

The nineteenth invention is the sanitary washing apparatus according to the eighteenth invention, wherein the drive unit displaces in conjunction with the movement of the washing nozzle.

According to this sanitary washing apparatus, the position of the drive unit changes in conjunction with the movement of the washing nozzle even when the washing nozzle changes from the stored state to the advanced state while transitioning to the orientation having the greater angle of the axis of the washing nozzle with respect to the horizontal plane. Therefore, the relationship between the push-out amount of the drive unit and the advancement amount of the washing nozzle can be maintained as linear. Thereby, the washing nozzle can be caused to stably advance. The washing nozzle can be moved accurately to the prescribed position in the case where the user adjusts the position of the washing nozzle.

The twentieth invention is the sanitary washing apparatus according to the eighteenth invention, wherein: a path traced by a tip of the washing nozzle when the washing nozzle changes from the stored state to the advanced state includes a curved path traced when transitioning to the orientation having the greater angle, and a straight-line path traced when the angle is constant; and a change amount of the angle of the axis of the washing nozzle with respect to the horizontal plane is the same as a change amount of an angle of the drive unit with respect to the horizontal plane when the tip traces the curved path.

According to this sanitary washing apparatus, the change amount of the angle of the axis of the washing nozzle with respect to the horizontal plane is the same as the change amount of the angle of the drive unit with respect to the horizontal plane when the tip of the washing nozzle traces the curved path. Therefore, the relationship between the push-out amount of the drive unit and the advancement amount of the washing nozzle can be maintained as linear. Thereby, the washing nozzle can be caused to stably advance.

The twenty-first invention is the sanitary washing apparatus according to the eighteenth invention, wherein the drive unit is disposed on a rear end side of the washing nozzle and is configured to displace upward and downward in conjunction with the movement of the washing nozzle.

According to this sanitary washing apparatus, the drive unit is disposed on the rear end side of the washing nozzle and displaces upward and downward in conjunction with the movement of the washing nozzle. Therefore, adhesion of a liquid such as water to the drive unit can be suppressed even in the case where such a liquid adheres to the washing nozzle. Thereby, failure of the drive unit due to the liquid can be suppressed.

The twenty-second invention is the sanitary washing apparatus according to the eighteenth invention, further including a base configured to slidably support the washing nozzle, the base being linked to the movement of the washing nozzle, the drive unit being fixed to the base.

According to this sanitary washing apparatus, the drive unit is fixed to a base that is linked to the movement of the washing nozzle. Therefore, the relative positions of the drive unit and the base do not change due to the movement of the washing nozzle. Therefore, the relationship between the push-out amount of the drive unit and the advancement amount of the washing nozzle can be maintained as linear. Thereby, the washing nozzle can be caused to stably advance.

The twenty-third invention is the sanitary washing apparatus according to the eighteenth invention, wherein the washing nozzle is a multistage washing nozzle including a plurality of movable portions.

According to this sanitary washing apparatus, the length of the washing nozzle in the axial direction in the stored state can be shorter. Thereby, the height of the washing nozzle in the stored state can be lower. Therefore, the height of the sanitary washing apparatus can be lower; and a compact sanitary washing apparatus can be realized.

The twenty-fourth invention is the sanitary washing apparatus according to the twenty-third invention, wherein: the multistage washing nozzle includes a nozzle head, the water discharge port being provided in the nozzle head, and at least one cylinder capable of storing at least a portion of the nozzle head; and the multistage washing nozzle changes from the stored state while transitioning to the orientation having the greater angle in the state of the nozzle head being stored inside the at least one cylinder, and the multistage washing nozzle subsequently changes to the advanced state with the angle in a constant state while the nozzle head slides out of the at least one cylinder.

According to this sanitary washing apparatus, the washing nozzle changes from the stored state while transitioning to the orientation having the greater angle of the axis of the washing nozzle with respect to the horizontal plane in a state in which the multistage washing nozzle is more compact. Thereby, the height of the washing nozzle in the stored state can be lower. Therefore, the height of the sanitary washing apparatus can be lower; and a compact sanitary washing apparatus can be realized.

Embodiments of the invention will now be described with reference to the drawings. Similar components in the drawings are marked with like reference numerals, and a detailed description is omitted as appropriate.

FIG. 1 is a schematic perspective view illustrating a toilet apparatus including a sanitary washing apparatus according to an embodiment of the invention.

The toilet apparatus illustrated in FIG. 1 includes a western-style sit-down toilet (hereinbelow called simply "toilet" for convenience of description) 800 and a sanitary washing apparatus 100 provided on the western-style sit-down toilet 800. The sanitary washing apparatus 100 includes a casing 400, a toilet seat 200, and a toilet lid 300. The toilet seat 200 and the toilet lid 300 are pivotally supported openably and closeably with respect to the casing 400.

The body wash functional unit that realizes the washing of the bottom and the like of a user sitting on the toilet seat 200 and the like are built into the interior of the casing 400. For example, a seat contact detection sensor 404 configured to sense when the user sits on the toilet seat 200 is provided in the casing 400. In the case where the seat contact detection sensor 404 senses that the user is sitting on the toilet seat 200, the user can cause a washing nozzle 473 to advance into a bowl 801 of the toilet 800 when the user operates a not-illustrated operation unit such as, for example, a remote control and the like. In the sanitary washing apparatus 100 illustrated in FIG. 1, the washing nozzle 473 is illustrated in the state of being advanced into the bowl 801.

One or multiple water discharge ports 474 are provided in the tip of the washing nozzle 473. Then, the washing nozzle 473 can wash the bottom and the like of the user sitting on the toilet seat 200 by squirting water from the water discharge port 474 provided in the tip of the washing nozzle 473. In the specification of the application, water includes not only cold water but also heated warm water.

Figure 2A:
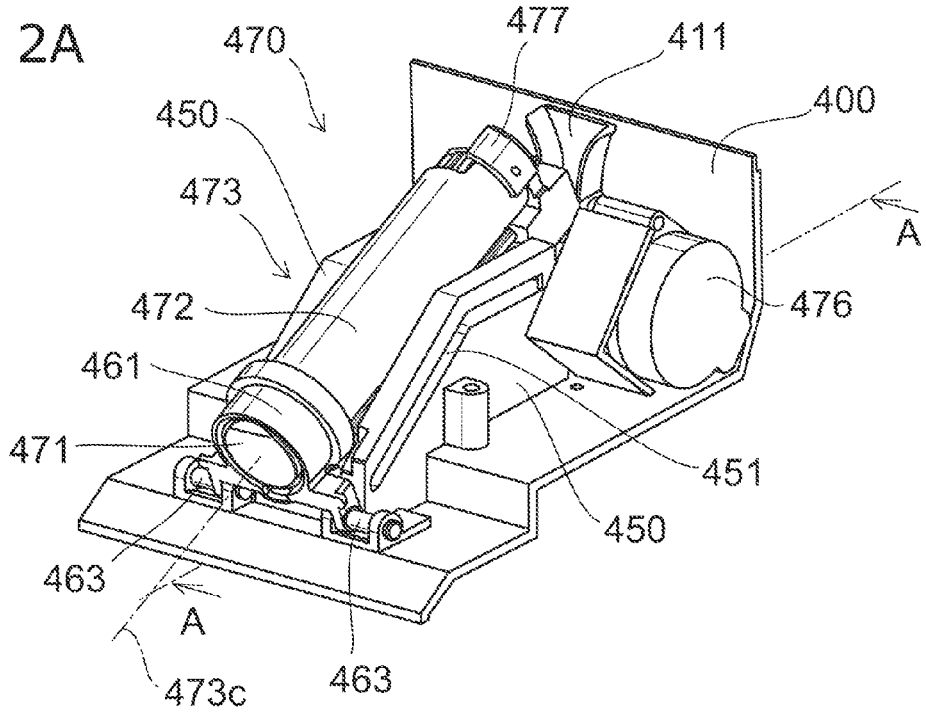
FIGS. 2A and 2B are schematic perspective views illustrating a nozzle unit of this embodiment.
Figure 2B:
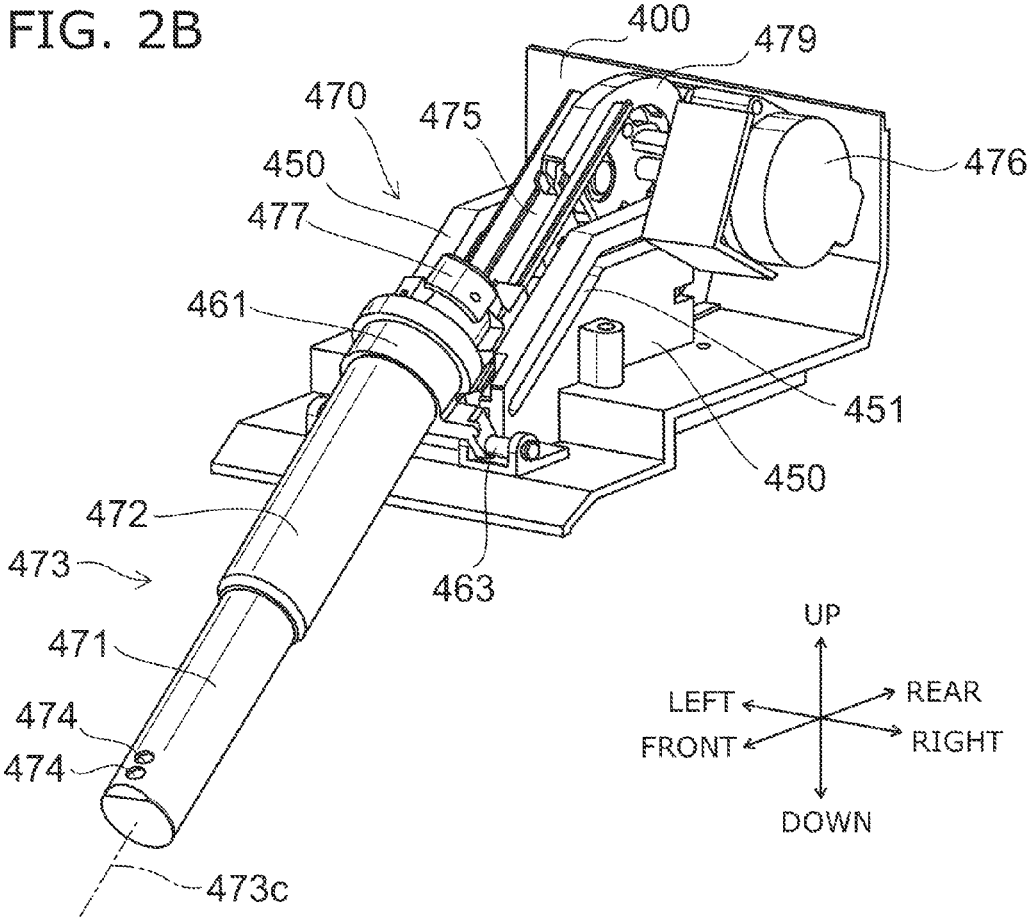

FIGS. 2A and 2B are schematic perspective views illustrating a nozzle unit of this embodiment.

Figure 3:
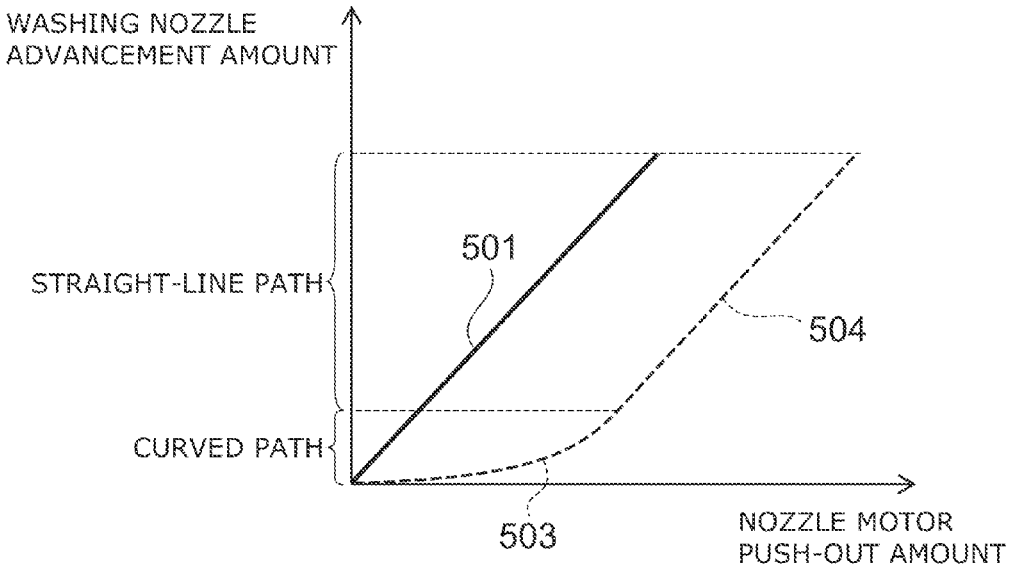
FIG. 3 is a graph illustrating the relationship between the push-out amount of the nozzle motor and the advancement amount of the washing nozzle.

FIG. 3 is a graph illustrating the relationship between the push-out amount of the nozzle motor and the advancement amount of the washing nozzle.

FIG. 2A is a schematic perspective view illustrating the state in which the washing nozzle is stored in the casing; and FIG. 2B is a schematic perspective view illustrating the state in which the washing nozzle is advanced. FIG. 3 illustrates the advancement amount of the washing nozzle 473 itself using the initial position (the position of the stored state) of the washing nozzle 473 as a reference.

As illustrated in FIGS. 2A and 2B, the nozzle unit 470 of this embodiment includes a base 475, the washing nozzle 473 supported by the base 475, and a nozzle motor (a drive unit) 476 configured to move the washing nozzle 473. The washing nozzle 473 includes a nozzle head 471 and a cylinder 472. In other words, the washing nozzle 473 illustrated in FIGS. 2A and 2B has two stages. Although a washing nozzle that has two stages, i.e., two movable portions, is described as an example in this embodiment, the invention is not limited thereto. A multistage washing nozzle having three or more movable portions and a single-stage washing nozzle having only the nozzle head as a movable portion are included in this embodiment.

The nozzle head 471 is provided slidably with respect to the cylinder 472; and at least a portion of the nozzle head 471 is storable inside the cylinder 472. The nozzle head 471 is provided to be slidable with respect to the base 475 due to the drive force transmitted from the nozzle motor 476. This is elaborated later.

The nozzle motor 476 is fixed to the base 475.

The washing nozzle 473 includes a slider 477. The cylinder 472 is fixed to the slider 477. The slider 477 is provided slidably with respect to the base 475. Therefore, the cylinder 472 is slidable with respect to both the slider 477 and the base 475. Thereby, the washing nozzle 473 can move advanceably from and retreatably into the casing 400 and the base 475.

Figure 5:
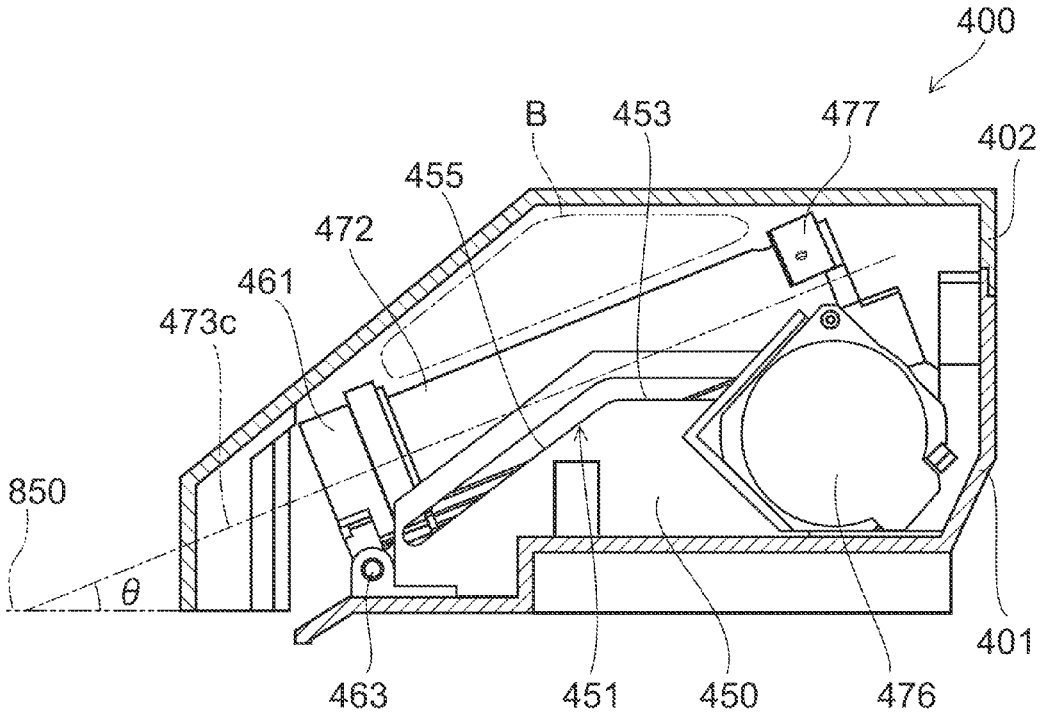
FIG. 5 is a schematic plan view illustrating the nozzle unit of this embodiment.

A path guide 450 configured to guide the movement of the washing nozzle 473 is provided in the casing 400. The washing nozzle 473 changes from the stored state to an advanced state by tracing a constant path due to the path guide 450. At this time, the washing nozzle 473 advances while transitioning to an orientation having a greater angle θ (referring to FIG. 5) of an axis 473*c* of the washing nozzle 473 with respect to, for example, a horizontal plane 850 (referring to FIG. 5) of the upper surface and the like of the toilet 800. In other words, the washing nozzle 473 advances while transitioning to an orientation that is more upright than the stored state.

Or, the washing nozzle 473 advances while transitioning to the orientation having the greater angle θ (referring to FIG. 5) of the axis 473*c* of the washing nozzle 473 with respect to, for example, the horizontal plane 850 (referring to FIG. 5) of the upper surface and the like of the toilet 800 by utilizing a space B (referring to FIG. 5) existing above the washing nozzle 473 in the stored state by a forward-advance operation of the washing nozzle 473. In other words, the washing nozzle 473 advances while transitioning to the orientation that is more upright than the stored state by utilizing the space B existing above the washing nozzle 473 in the stored state by the forward-advance operation of the washing nozzle 473.

Then, although described below with reference to FIG. 4, a tip 473*a* of the washing nozzle 473 advances while tracing a curved path 491 and subsequently advances while tracing a straight-line path 493.

Here, in the case where, for example, the nozzle motor 476 is fixed to the casing 400, the relative positions of the nozzle motor 476 and the base 475 change due to the advance of the washing nozzle 473. In such a case, there is a risk that the drive force transmitted from the nozzle motor 476 to the nozzle head 471 may change by being absorbed by the advance of the washing nozzle 473 when the tip 473*a* of the washing nozzle 473 advances while tracing the curved path 491. Therefore, there is a risk that the relationship between the push-out amount of the nozzle motor 476 and the advancement amount of the washing nozzle 473 may not be linear and may be like a curve 503 illustrated in FIG. 3. Thereby, there is a risk that the washing nozzle 473 cannot be stably advanced and the washing nozzle 473 cannot be accurately moved to the prescribed position even in the case where the user adjusts the position of the washing nozzle 473. In the case where the tip 473*a* of the washing nozzle 473 advances while tracing the straight-line path 493, the relationship between the push-out amount of the nozzle motor 476 and the advancement amount of the washing nozzle 473 is linear like a straight line 504 illustrated in FIG. 3.

Conversely, in this embodiment, the nozzle motor 476 is fixed to the base 475. Because the washing nozzle 473 is provided slidably with respect to the base 475, the base 475 transitions to the orientation of being upright in conjunction with the advance of the washing nozzle 473 as illustrated in FIG. 2A and FIG. 2B. Therefore, the nozzle motor 476 displaces in conjunction with the advance of the washing nozzle 473. Then, the relative positions of the base 475 and the nozzle motor 476 do not change due to the advance of the washing nozzle 473.

Thereby, the drive force transmitted from the nozzle motor 476 to the nozzle head 471 is maintained at substantially a constant. That is, because the washing nozzle 473 advances while transitioning to the orientation that is more upright than the stored state, the loss of the drive force transmitted from the nozzle motor 476 to the nozzle head 471 does not occur. Alternatively, the relationship between the push-out amount of the nozzle motor 476 and the advancement amount of the washing nozzle 473 is linear like a straight line 501 illustrated in FIG. 3 when the tip 473*a* of the washing nozzle 473 advances while tracing the curved path 491 and the straight-line path 493. Herein, linear means that the relationship between the push-out amount of the nozzle motor 476 and the advancement amount of the washing nozzle 473 is expressed by a first order equation. Therefore, the washing nozzle 473 can advance with a substantially constant drive force transmitted from the nozzle motor 476. Thereby, the washing nozzle 473 can stably advance. In the case where the user adjusts the position of the washing nozzle 473, the washing nozzle 473 can be moved accurately to the prescribed position. The washing nozzle 473 can be moved accurately to the prescribed position to prevent pushing out more than necessary for the advancing.

The advance operation of the washing nozzle will now be described in detail with reference to the drawings.

Figure 4:
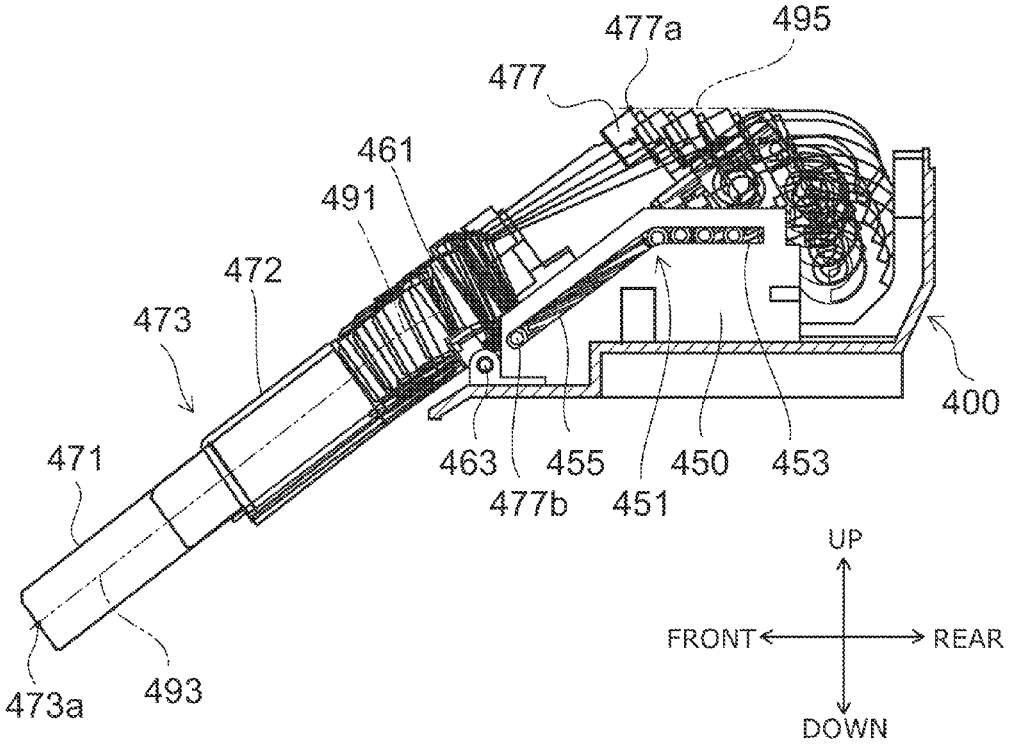
FIG. 4 is a schematic plan view illustrating the path of the washing nozzle of this embodiment.

FIG. 4 is a schematic plan view illustrating the path of the washing nozzle of this embodiment.

FIG. 5 and FIGS. 6A to 6C are schematic plan views illustrating the nozzle unit of this embodiment.

FIGS. 7A to 7D are schematic cross-sectional views illustrating the nozzle unit of this embodiment.

FIG. 4 to FIGS. 6A to 6C are schematic plan views of the nozzle unit 470 of this embodiment as viewed from the right. FIGS. 7A to 7D are schematic cross-sectional views of a cross-section along the axis 473*c* of the washing nozzle 473, i.e., the cross-section A-A illustrated in FIG. 2A. The nozzle motor 476 is omitted for convenience of description in the nozzle unit 470 illustrated in FIGS. 6A to 6C.

The casing 400 includes a case plate 401 and a case cover 402 as illustrated in FIG. 5 to FIGS. 7A to 7D. The body washing functional unit and the like are appropriately disposed in the case plate 401 and covered with the case cover 402 from above.

As illustrated in FIGS. 7A to 7D, a cable rack 478 (a transmission unit) is fixed to the nozzle head 471. The cable rack 478 is formed of a material such as, for example, a flexible resin and the like. An unevenness is provided on at least one side surface of the cable rack 478 to mesh with gears (transmission units) 481 and 483. The cable rack 478 is supported slidably inside the sanitary washing apparatus 100 along a first cable guide unit 479 provided in the base 475 and a second cable guide unit 411 provided in the casing 400.

The nozzle motor 476 is capable of outputting the drive output to the gears 481 and 483 by an appropriate reduction. The cable rack 478 moves the nozzle head 471 by meshing with the gear 483 and converting the rotational drive force of the gear 483 into a drive force in a linear direction. That is, the nozzle head 471 is provided to be slidable with respect to the base 475 due to the drive force transmitted from the nozzle motor 476 via the gears 481 and 483 and the cable rack 478.

As illustrated in FIG. 4 to FIG. 6C, a path groove 451 configured to regulate the path of the washing nozzle 473 is made in the path guide 450. On the other hand, as illustrated in FIG. 4 and FIGS. 6A to 6C, an engaging portion 477*b* that is engageable with the path groove 451 is provided in the slider 477. The engaging portion 477*b* engages the path groove 451. The engaging portion 477*b* of the slider 477 moves while sliding through the path groove 451 when the washing nozzle 473 changes from the stored state to the advanced state. Therefore, the slider 477 moves by tracing substantially the same path as the path groove 451.

For example, the engaging portion 477*b* may be added to the slider 477 as a non-rotatable protruding portion and may have a portion that is rotatable with respect to the slider 477. In the case where the engaging portion 477*b* has a portion that is rotatable with respect to the slider 477, the engaging portion 477*b* of the slider 477 moves through the path groove 451 while rotating. Therefore, not only the case of sliding motion in a contact state but also the case of rolling motion in the contact state are included in the scope of sliding in the specification of the application.

The path guide 450 includes a curve regulator 453 and a straight-line regulator (an angle regulator) 455. The curve regulator 453 is made in substantially the horizontal direction. On the other hand, the straight-line regulator 455 is made to be tilted such that one end portion of the straight-line regulator 455 on the side connected to the curve regulator 453 is higher than the other end portion of the straight-line regulator 455 on the side not connected to the curve regulator 453. In other words, the straight-line regulator 455 is made to be tilted such that the other end portion of the straight-line regulator 455 on the side not connected to the curve regulator 453 is lower than the one end portion of the straight-line regulator 455 on the side connected to the curve regulator 453. The straight-line regulator 455 may have a lock mechanism; and a driving unit for modifying the angle may be provided in the straight-line regulator 455.

First, when the washing nozzle 473 starts to change from the stored state to the advanced state, the engaging portion 477*b* of the slider 477 slides through the curve regulator 453. At this time, as illustrated in FIGS. 2A and 2B, the cylinder 472 passes through a tubular body 461 which is pivotally supported rotatably with respect to the casing 400 by a rotation shaft 463. The tubular body 461 is formed in a tubular configuration and can rotate around the rotation shaft 463 according to the angle of the cylinder 472. Then, the tubular body 461 and the rotation shaft 463 can guide and regulate the movement of the washing nozzle 473.

Therefore, the engaging portion 477*b* moves in substantially the horizontal direction by being guided by the curve regulator 453 when the washing nozzle 473 starts to change from the stored state to the advanced state. On the other hand, the cylinder 472 passes through the interior of the tubular body 461 which rotates around the rotation shaft 463. Thereby, the washing nozzle 473 advances while transitioning to the orientation having the greater angle θ of the axis 473*c* of the washing nozzle 473 with respect to the horizontal plane 850. In other words, the washing nozzle 473 advances while transitioning to the orientation that is more upright than the stored state. Therefore, the tip 473*a* of the washing nozzle 473 (the tip of the nozzle head 471) advances while tracing the curved path 491 as illustrated in FIG. 4 when the engaging portion 477*b* of the slider 477 slides through the curve regulator 453.

At this time, the slider 477 advances by tracing substantially the same path as the path groove 451 made in the path guide 450. Therefore, an upper end portion 477*a* of the slider 477 advances while tracing substantially a horizontal path 495 or a path 495 that moves frontward and downward as illustrated in FIG. 4 when the engaging portion 477*b* slides through the curve regulator 453. In other words, the upper end portion 477*a* of the slider 477 moves directly under the case cover 402. Therefore, the washing nozzle 473 can advance while transitioning to the orientation that is more upright than the stored state by utilizing the space B existing above the washing nozzle 473 in the stored state by the forward-advance operation of the washing nozzle 473. Therefore, a special space is unnecessary for the washing nozzle 473 to transition to the orientation that is more upright than the stored state. Thereby, the height of the case cover 402 can be reduced to the maximum height of the washing nozzle 473 in the stored state. Therefore, the height of the sanitary washing apparatus 100 can be lower; and a compact sanitary washing apparatus 100 can be realized.

The rotation shaft 463 positioned at the rotation center of the tubular body 461 is provided on the tip side of the washing nozzle 473 in the stored state. Therefore, the movement amount of the tip 473*a* of the washing nozzle 473 is smaller than the movement amounts of the rear end portion of the washing nozzle 473 and the upper end portion 477*a* (the upper end portion of the slider 477) when the engaging portion 477*b* slides through the curve regulator 453. For example, the length of the curved path 491 of the tip 473*a* of the washing nozzle 473 is shorter than the length of the path 495 of the upper end portion 477*a* of the slider 477. Therefore, the space where the washing nozzle 473 moves on the front side of the sanitary washing apparatus 100 can be reduced. Therefore, the front portion of the casing 400 positioned proximally to the toilet seat 200 can be lower and can have a smooth configuration along the toilet seat 200. Thereby, a compact sanitary washing apparatus 100 having better designability can be realized.

In this embodiment, the rotation shaft 463 is provided in the casing 400. Therefore, the relative position of the rotation shaft 463 as viewed from the casing 400 does not change. On the other hand, the relative position of the rotation shaft 463 as viewed from the washing nozzle 473 changes between the tip side and the rear end side of the washing nozzle 473 with the movement of the washing nozzle 473. Thus, the angle θ of the axis 473*c* of the washing nozzle 473 with respect to the horizontal plane 850 can be changed without moving the rotation shaft 463 with respect to the casing 400. Therefore, the height of the sanitary washing apparatus 100 can be lower; and a compact sanitary washing apparatus 100 can be realized.

Or, the rotation shaft 463 may be provided not in the casing 400 but in the washing nozzle 473. In such a case, the relative position of the rotation shaft 463 as viewed from the washing nozzle 473 does not change. For example, a guide unit that is capable of guiding the movement of the washing nozzle 473 is provided on the tip side of the washing nozzle 473. For example, the engaging portion (the rotation shaft) 477*b* that includes the portion that is rotatable with respect to the slider 477 corresponds to such a rotation shaft 463. In such a case as well, the movement amount of the tip 473*a* of the washing nozzle 473 is smaller than the movement amounts of the rear end portion and the upper end portion 477*a* of the washing nozzle 473 when the engaging portion 477*b* slides through the curve regulator 453. Thereby, effects similar to those of the case where the rotation shaft 463 is fixed to the casing 400 are obtained. Further, the rotation shaft 463 provided on the tip side of the washing nozzle 473 in the stored state may be unnecessary by providing the rotation shaft 463 in the washing nozzle 473. Thereby, the affixation of, for example, urine, dirt, and the like to the rotation shaft 463 and poor operational performance of the rotation shaft 463 can be suppressed.

The disposition method of the rotation shaft 463 is not limited only thereto. For example, the rotation shaft 463 may be provided in both the washing nozzle 473 and in the casing 400 on the tip side of the washing nozzle 473 in the stored state. Alternatively, the rotation shaft 463 may be provided only in the casing 400 on the tip side of the washing nozzle 473 in the stored state.

For example, in the case where the washing nozzle 473 advances while transitioning to the orientation that is more upright than the stored state by the tip side of the washing nozzle 473 displacing downward, a mechanism and space to change the angle of the washing nozzle 473 become necessary in the front portion of the casing 400. In such a case, there is a risk that the front portion of the casing 400 cannot be compact.

Conversely, in this embodiment, by the upper end portion 477*a* of the slider 477 tracing the substantially horizontal path 495 or the path 495 that moves frontward and downward, the washing nozzle 473 advances while transitioning to the orientation that is more upright than the stored state. Therefore, the mechanism and the space to change the angle of the washing nozzle 473 can be smaller at the front portion of the casing 400. Then, the washing nozzle 473 can advance while transitioning to the orientation that is more upright than the stored state by utilizing the space B existing above the washing nozzle 473 in the stored state by the forward-advance operation of the washing nozzle 473. Therefore, the front portion of the casing 400 positioned proximally to the toilet seat 200 can be lower and may have a smooth configuration along the toilet seat 200. Thereby, a compact sanitary washing apparatus 100 having better designability can be realized.

Continuing, the engaging portion 477*b* of the slider 477 slides through the straight-line regulator 455. At this time, the tilt angle of the straight-line regulator 455, i.e., the movement direction of the slider 477 and the cylinder 472, is substantially the same as the axial direction of the tubular body 461 because the tubular body 461 is pivotally supported rotatably with respect to the casing 400. Thereby, the tip 473*a* of the washing nozzle 473 advances while tracing the straight-line path 493 as illustrated in FIG. 4 when the engaging portion 477*b* of the slider 477 slides through the straight-line regulator 455.

Here, as described above in regard to FIGS. 2A and 2B and FIG. 3, the base 475 transitions to the orientation of being upright in conjunction with the advance of the washing nozzle 473. The nozzle motor 476 displaces in conjunction with the advance of the washing nozzle 473 by being fixed to the base 475. Therefore, the change amount of the angle of the nozzle motor 476 with respect to the horizontal plane 850 is the same as the change amount of the angle θ of the axis 473*c* of the washing nozzle 473 with respect to the horizontal plane 850. In other words, the base 475 and the nozzle motor 476 move while tracing the same path. Therefore, the drive force transmitted from the nozzle motor 476 to the nozzle head 471 is maintained at substantially a constant. Alternatively, the relationship between the push-out amount of the nozzle motor 476 and the advancement amount of the washing nozzle 473 is linear. Thereby, the washing nozzle 473 can be caused to stably advance. The washing nozzle 473 can be moved accurately to the prescribed position in the case where the user adjusts the position of the washing nozzle 473.

The nozzle motor 476 is provided on the rear end side of the washing nozzle 473. Then, the nozzle motor 476 displaces upward and downward in conjunction with the advance and retreat of the washing nozzle 473 as illustrated in FIG. 4. Therefore, the adhesion of a liquid such as water to the nozzle motor 476 can be suppressed even in the case where such a liquid adheres to the washing nozzle. Thereby, the failure of the nozzle motor 476 due to the liquid can be suppressed.

The rotation shaft 463 positioned at the rotation center of the tubular body 461 is provided on the tip side of the washing nozzle 473 in the stored state. Therefore, the displacement amount of the tip 473*a* of the washing nozzle 473 is smaller than the displacement amount of the rear end portion and the upper end portion 477*a* (the upper end portion of the slider 477) of the washing nozzle 473 when the engaging portion 477*b* slides through the curve regulator 453. For example, the length of the curved path 491 of the tip 473*a* of the washing nozzle 473 is shorter than the length of the path 495 of the upper end portion 477*a* of the slider 477. Therefore, the space where the washing nozzle 473 moves on the front side of the sanitary washing apparatus 100 can be reduced. Thereby, a compact sanitary washing apparatus 100 can be realized.

As illustrated in this embodiment, at least a portion of the nozzle head 471 is storable inside the cylinder 472 in the case where the washing nozzle 473 is a multistage washing nozzle. Therefore, the length of the washing nozzle 473 in the axis 473*c* direction in the stored state can be shorter. Thereby, the height of the washing nozzle 473 in the stored state can be lower. Therefore, the height of the sanitary washing apparatus 100 can be lower; and a compact sanitary washing apparatus 100 can be realized.

When the washing nozzle 473 advances, the base 475 and the nozzle motor 476 displace in conjunction with the advance of the washing nozzle 473 as illustrated in FIG. 4 and FIGS. 6A to 6C. Therefore, the relative positions of the base 475 and the nozzle motor 476 do not change due to the advance of the washing nozzle 473.

The advancement order of the nozzle head 471 and the cylinder 472 is not particularly limited. For example, the tip 473*a* of the washing nozzle 473 advances while tracing the curved path 491 in the state in which the nozzle head 471 is stored inside the cylinder 472. Subsequently, the nozzle head 471 slides out of the cylinder 472; and the tip 473*a* of the washing nozzle 473 advances while tracing the straight-line path 493. In such a case, the tip 473*a* of the washing nozzle 473 advances while tracing the curved path 491 in a state in which the multistage washing nozzle 473 is more compact. Thereby, the height of the washing nozzle 473 in the stored state can be lower. Therefore, the height of the sanitary washing apparatus 100 can be lower; and a compact sanitary washing apparatus 100 can be realized.

Or, for example, the operation of the tip 473*a* of the washing nozzle 473 advancing while tracing the curved path 491 may be performed in parallel with the operation of the nozzle head 471 sliding out of the cylinder 472.

According to this embodiment, the washing nozzle 473 advances while transitioning to the orientation having the greater angle θ of the axis 473*c* of the washing nozzle 473 with respect to the horizontal plane 850. Therefore, the washing nozzle 473 can be stored at an orientation at which the angle θ of the axis 473*c* of the washing nozzle 473 with respect to the horizontal plane 850 is smaller than that of the advanced state. The rotation space necessary to change the angle θ of the axis 473*c* of the washing nozzle 473 with respect to the horizontal plane 850 can be minimized. Thereby, the height of the washing nozzle 473 in the stored state can be lower. Therefore, the height of the sanitary washing apparatus 100 can be lower; and a compact sanitary washing apparatus 100 can be realized.

As illustrated in FIG. 4, the straight-line path 493 corresponds to the final portion of the path of the tip 473*a* of the washing nozzle 473. In other words, the tip 473*a* of the washing nozzle 473 traces the straight-line path 493 after the curved path 491. Therefore, for example, the discharge range of the wash water squirted from the washing nozzle 473 does not change even in the case where the function (the moving function) in which the user can adjust the position of the washing nozzle 473 is used. Therefore, the washing sensation due to the wash water squirted from the washing nozzle 473 can be stabilized. The tip 473*a* of the washing nozzle 473 may trace the straight-line path 493, subsequently trace the curved path 491, and finally trace the straight-line path 493. In other words, in this embodiment, it is sufficient for the straight-line path 493 to correspond to the final portion of the path of the tip 473*a* of the washing nozzle 473.

As illustrated in FIG. 4, the length of the straight-line path 493 is longer than the length of the curved path 491. Therefore, a wider washing range can be ensured. Thereby, the sanitary washing apparatus 100 according to this embodiment can execute the moving function while stabilizing the washing sensation over a wider range.

The angle of the straight-line path 493 with respect to the horizontal plane 850 is regulated by the tilt angle of the straight-line regulator 455. Therefore, the angle of the straight-line path 493 with respect to the horizontal plane 850 does not change with each movement of the washing nozzle 473. Therefore, it is unnecessary to adjust the washing nozzle 473 to the preferred position each time the user uses the sanitary washing apparatus 100. Thereby, the ease of use of the sanitary washing apparatus 100 according to this embodiment can be even better.

The path of the washing nozzle 473 is regulated by the path guide 450. Therefore, the washing nozzle 473 changes to the advanced state from the stored state while tracing substantially the same path each time. In this embodiment, the path groove 451 is made in the path guide 450; and the engaging portion 477*b* engages the path groove 451. Therefore, shifting of the path of the washing nozzle 473 is suppressed; and the washing nozzle 473 can be caused to stably advance. Thereby, the movement of the washing nozzle 473 and the reliability of the sanitary washing apparatus 100 can be improved further.

Figure 6A:
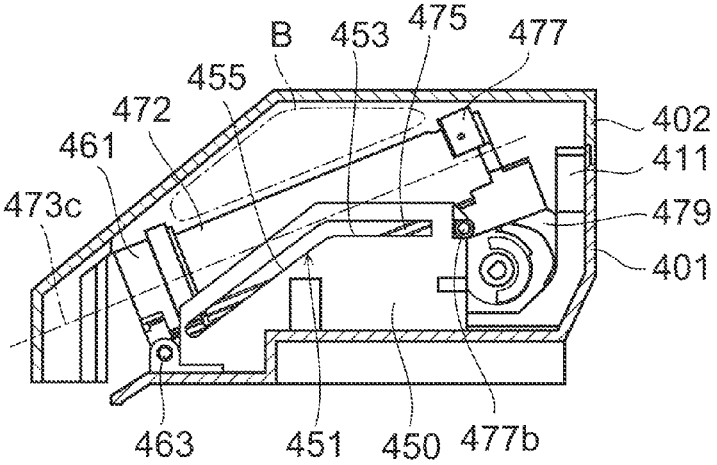
FIGS. 6A to 6C are schematic plan views illustrating the nozzle unit of this embodiment.
Figure 6B:
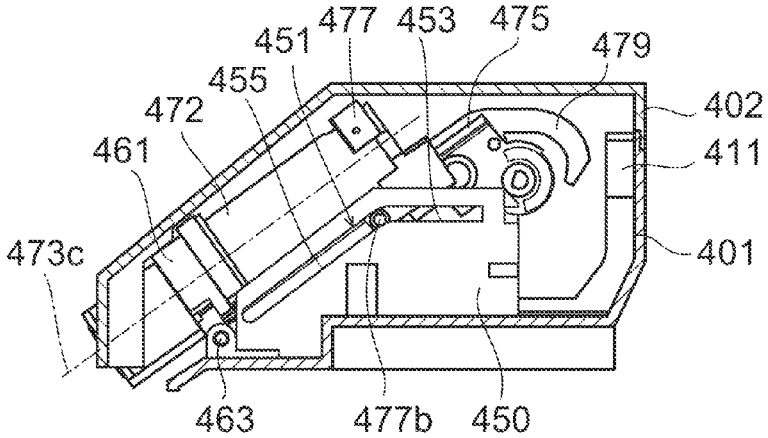
Figure 6C:
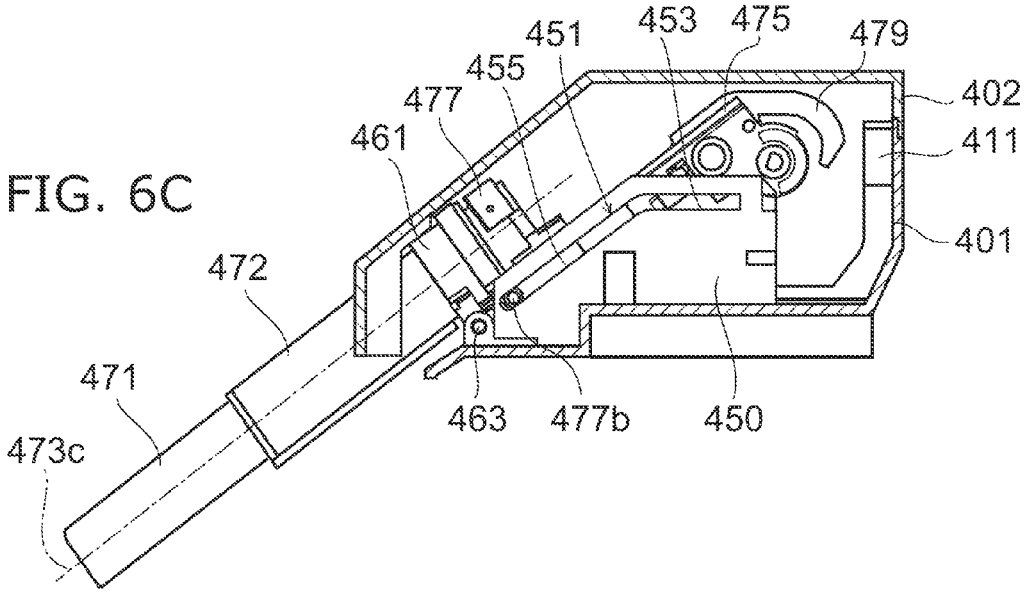
Figure 7A:
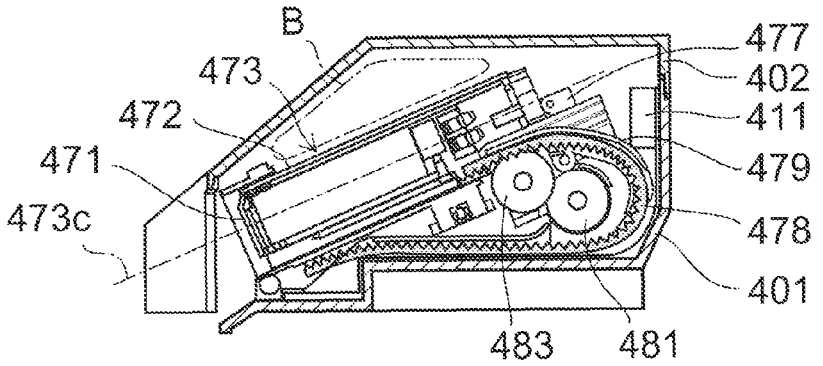
FIGS. 7A to 7D are schematic cross-sectional views illustrating the nozzle unit of this embodiment.
Figure 7B:
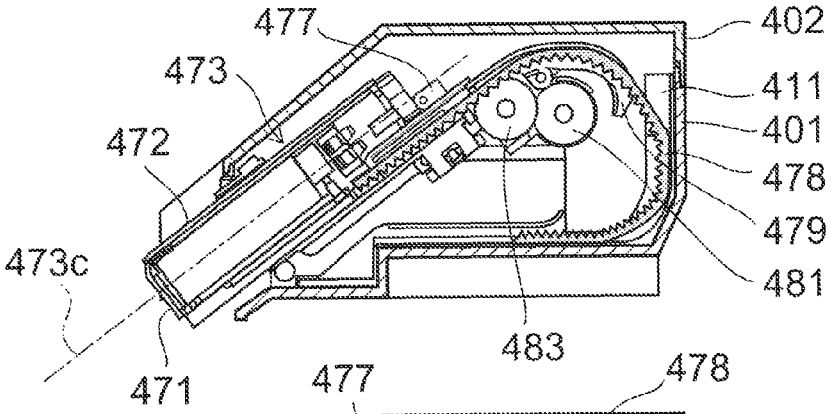
Figure 7C:
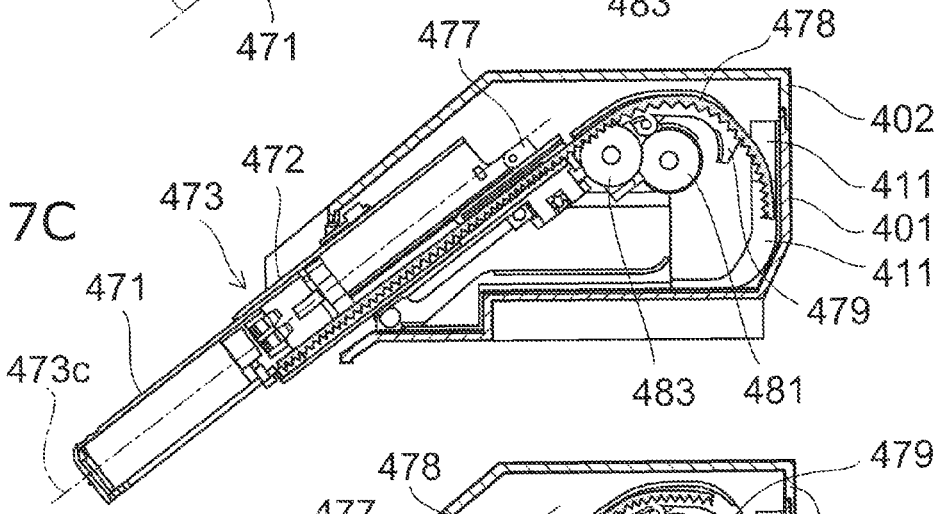
Figure 7D:
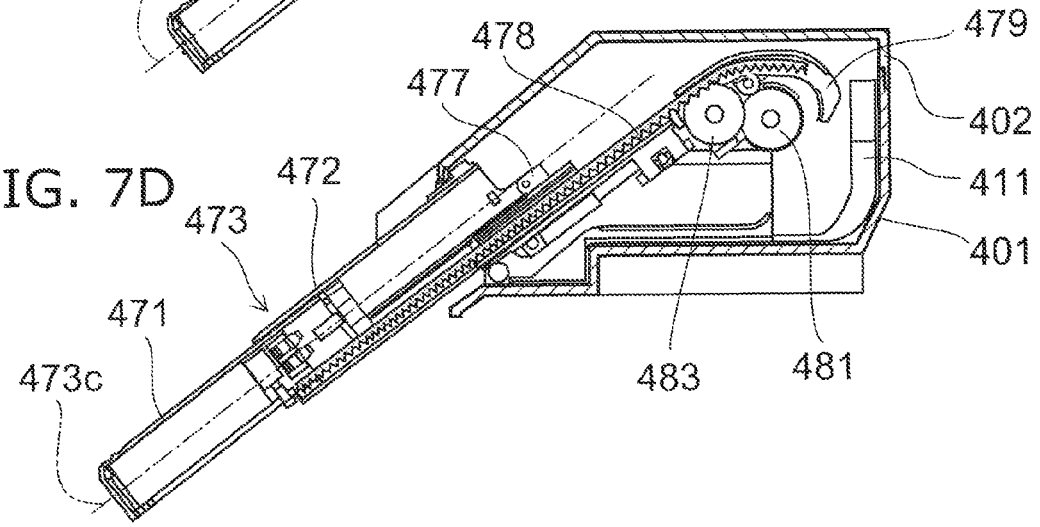

As illustrated in FIGS. 6A to 6C, the engaging portion 477*b* is provided on the rear end portion side of the washing nozzle 473. The path guide 450 is disposed and fixed inside the casing 400. That is, the path guide 450 does not move with the washing nozzle 473. Therefore, the path of the washing nozzle 473 illustrated in FIG. 4 can be formed using the members and the structures provided in the interior of the casing 400. Thereby, the height of the washing nozzle 473 in the stored state can be lower with a simpler structure. Therefore, the height of the sanitary washing apparatus 100 can be lower; and a compact sanitary washing apparatus 100 can be realized.

As described above, the nozzle motor 476 displaces in conjunction with the advance of the washing nozzle 473 by being fixed to the base 475. Therefore, the change amount of the angle of the nozzle motor 476 with respect to the horizontal plane 850 is the same as the change amount of the angle θ of the axis 473*c* of the washing nozzle 473 with respect to the horizontal plane 850. In other words, the base 475 and the nozzle motor 476 move while tracing the same path. Therefore, the drive force transmitted from the nozzle motor 476 to the nozzle head 471 is maintained at substantially a constant. That is, the washing nozzle 473 can advance with a substantially constant drive force transmitted from the nozzle motor 476. Alternatively, the relationship between the rotation angle of the nozzle motor 476 and the advancement amount of the washing nozzle 473 is linear. Thereby, the washing nozzle 473 can be caused to stably advance. The washing nozzle 473 can be moved accurately to the prescribed position in the case where the user adjusts the position of the washing nozzle 473.

The slider 477 advances by tracing substantially the same path as the path groove 451 made in the path guide 450. Therefore, the upper end portion 477*a* of the slider 477 advances while tracing the substantially horizontal path 495 or the curved path 495 that moves frontward and downward as illustrated in FIG. 4 when the engaging portion 477*b* slides through the curve regulator 453. Therefore, the washing nozzle 473 can advance while transitioning to the orientation that is more upright than the stored state by utilizing the space B existing above the washing nozzle 473 in the stored state (referring to FIG. 5 to FIG. 7D) by the forward-advance operation of the washing nozzle 473. Therefore, a special space is unnecessary for the washing nozzle 473 to transition to the orientation that is more upright than the stored state. Thereby, the height of the case cover 402 can be lower. Therefore, the height of the sanitary washing apparatus 100 can be lower; and a compact sanitary washing apparatus 100 can be realized.

Figure 8:
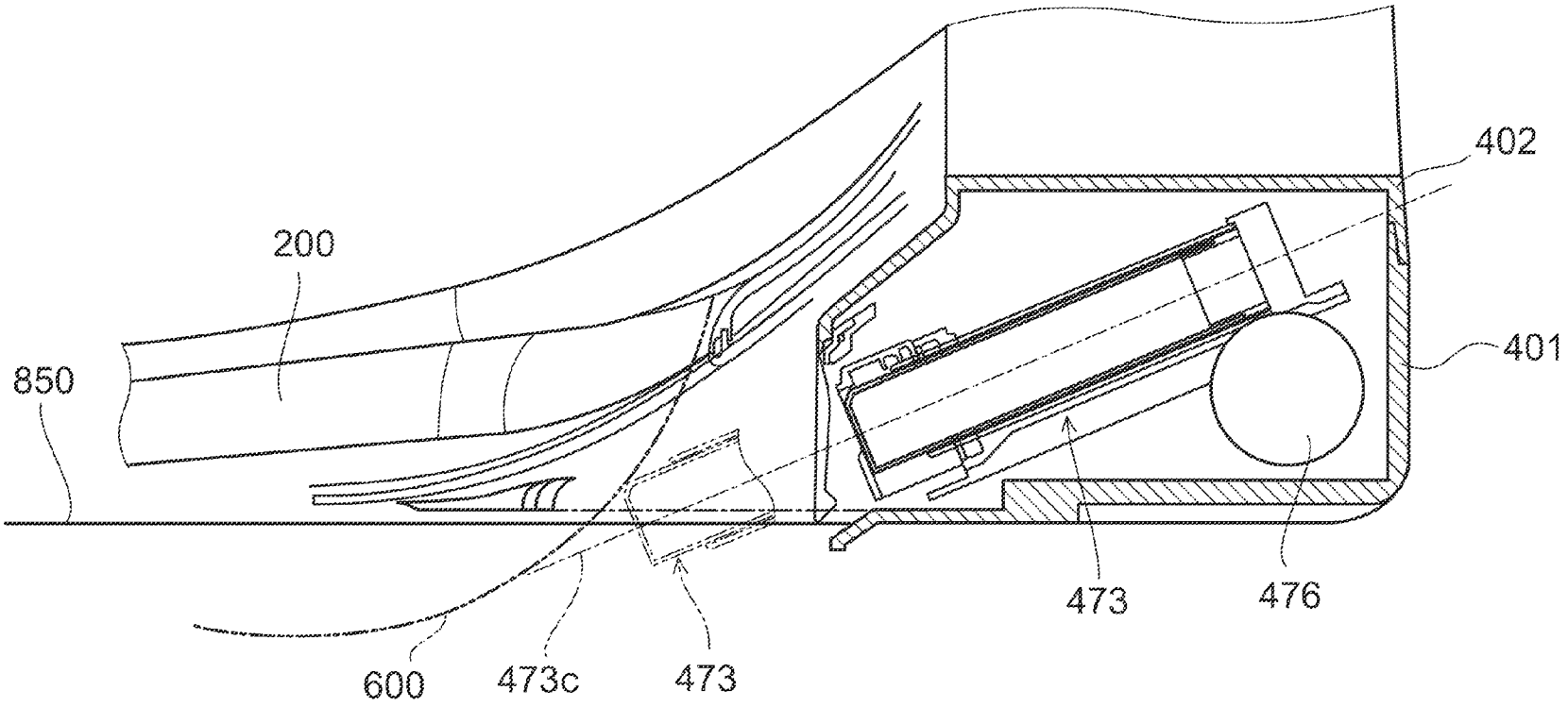
FIG. 8 is a schematic plan view illustrating the positional relationship between the washing nozzle in the stored state and the rear of the user seated on the toilet seat.

FIG. 8 is a schematic plan view illustrating the positional relationship between the washing nozzle in the stored state and the rear of the user seated on the toilet seat.

Figure 9:
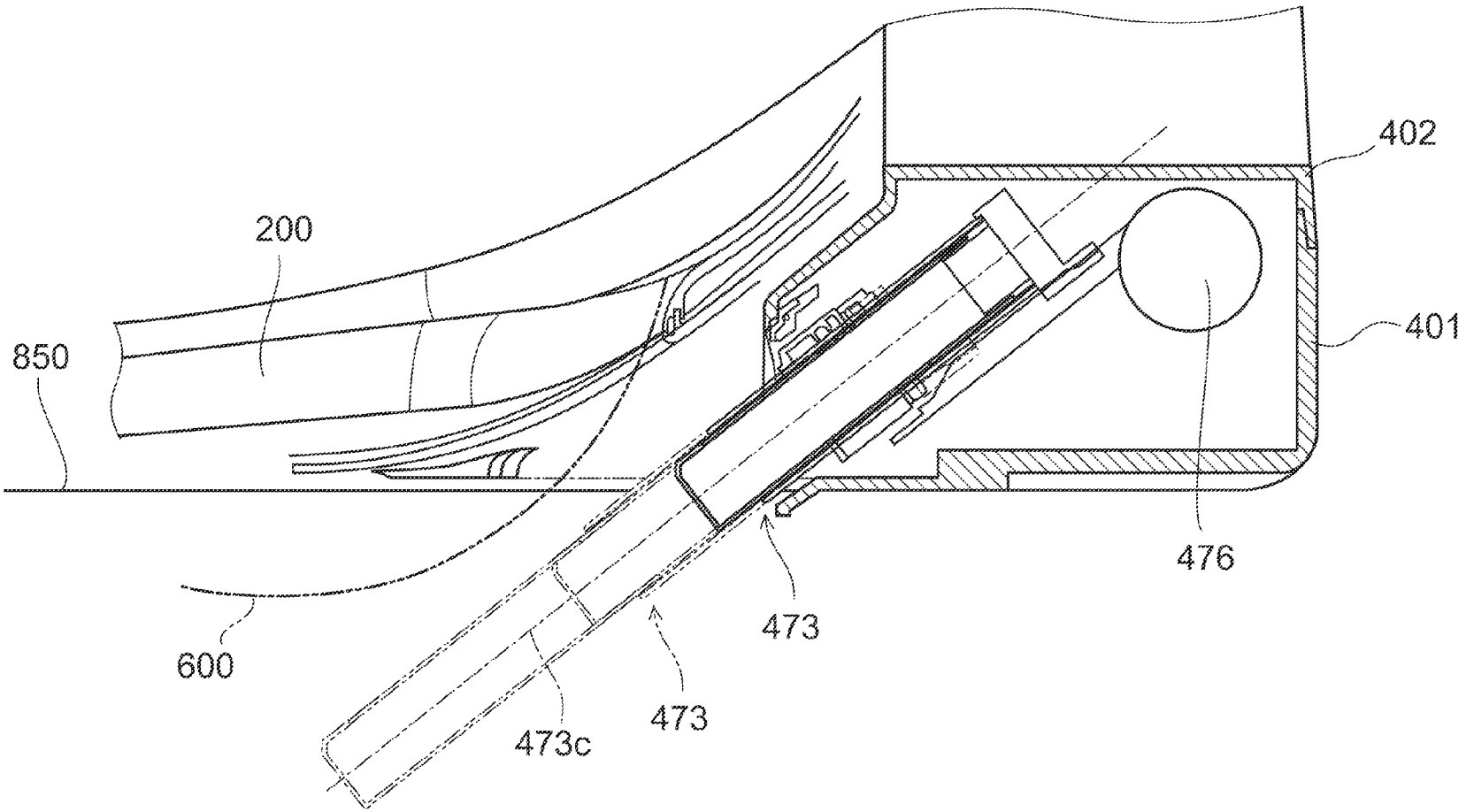
FIG. 9 is a schematic plan view illustrating the positional relationship between the washing nozzle in the advanced state and the rear of the user seated on the toilet seat.
Figure 10A:
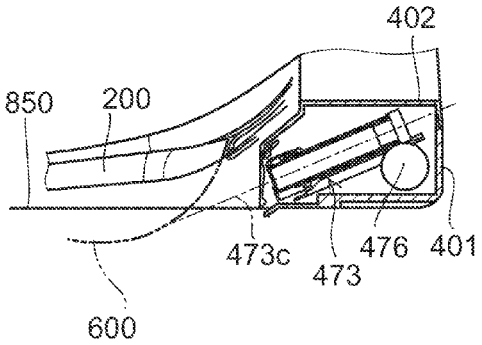
FIGS. 10A to 10F are schematic plan views illustrating the positional relationship between the washing nozzle and the rear of the user seated on the toilet seat partway through the advance.
Figure 10B:
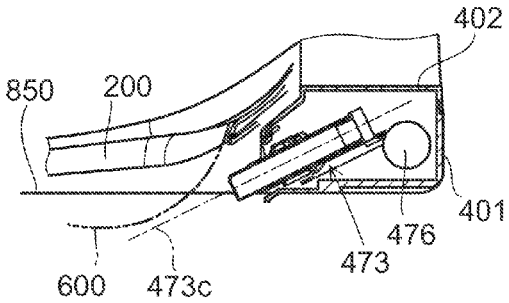
Figure 10C:
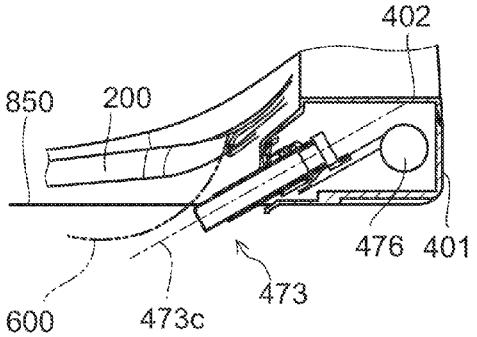
Figure 10D:
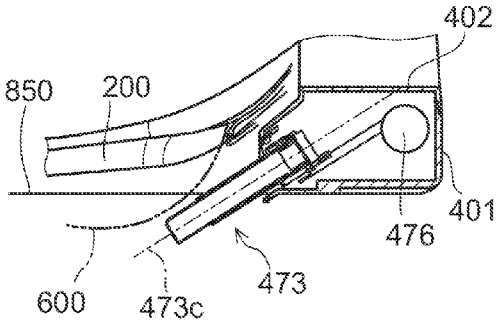
Figure 10E:
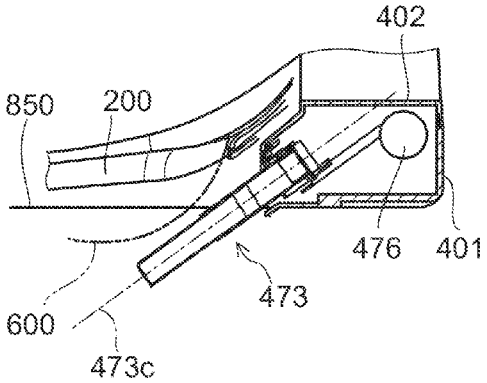
Figure 10F:
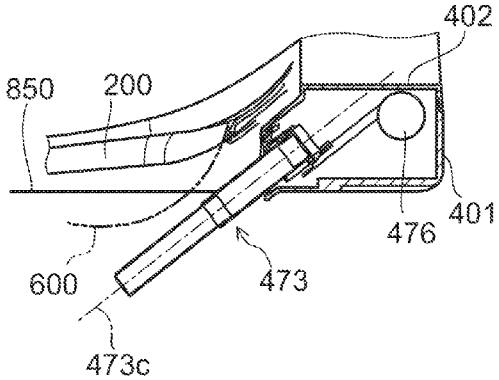

FIG. 9 is a schematic plan view illustrating the positional relationship between the washing nozzle in the advanced state and the rear of the user seated on the toilet seat.

FIGS. 10A to 10F are schematic plan views illustrating the positional relationship between the washing nozzle and the rear of the user seated on the toilet seat partway through the advance.

As described above in regard to FIG. 4 to FIG. 7D, in this embodiment, the washing nozzle 473 can be stored at an orientation at which the angle θ of the axis 473*c* of the washing nozzle 473 with respect to the horizontal plane 850 is smaller than that of the advanced state. More specifically, as illustrated in FIG. 8, the axis 473*c* of the washing nozzle 473 in the stored state interferes with the rear 600 of the user seated on the toilet seat 200. In other words, the angle θ of the axis 473*c* of the washing nozzle 473 with respect to the horizontal plane 850 in the stored state is the angle at which the washing nozzle 473 would contact the rear 600 of the user seated on the toilet seat 200 if the washing nozzle 473 advanced as-is at the orientation (the angle) of the stored state.

Conversely, as illustrated in FIGS. 10A to 10F, the washing nozzle 473 of this embodiment advances while transitioning to the orientation having the greater angle θ of the axis 473*c* of the washing nozzle 473 with respect to the horizontal plane 850. Therefore, as illustrated in FIG. 9, the axis 473*c* of the washing nozzle 473 in the advanced state does not interfere with the rear 600 of the user seated on the toilet seat 200. As illustrated in FIG. 9 and FIGS. 10A to 10F, the washing nozzle 473 does not contact the rear 600 of the user seated on the toilet seat 200 in the advanced state and partway through the advance. In this embodiment, the curved path 491 traced by the tip 473*a* of the washing nozzle 473 is a path to cause the washing nozzle 473 to avoid contacting the rear 600 of the user seated on the toilet seat 200. On the other hand, the straight-line path 493 traced by the tip 473*a* of the washing nozzle 473 is a path to cause the washing nozzle 473 to reach the advanced state. Thereby, the washing nozzle 473 can be stored at an orientation having an angle θ of the axis 473*c* of the washing nozzle 473 with respect to the horizontal plane 850 small enough that the axis 473*c* of the washing nozzle 473 in the stored state would interfere with the rear 600 of the user seated on the toilet seat 200. The washing nozzle 473 can be reliably prevented from interfering with the rear 600 of the user when transitioning from the curved path 491 to the straight-line path 493 at the timing of the tip 473*a* of the washing nozzle 473 reaching the tip of the rear portion of the toilet seat 200.

In the case where the sanitary washing apparatus 100 that includes the toilet seat 200 and the toilet 800 of general configurations and the washing nozzle 473 mounted in a general storage position (e.g., the position in the horizontal direction and the vertical direction relative to the rear 600) is used, the angle θ to avoid the interference between the washing nozzle 473 and the rear 600 of the user is, for example, about 30° to 45°.

According to this embodiment, contact between the rear 600 of the user seated on the toilet seat 200 and the washing nozzle 473 in the advanced state and partway through the advance can be avoided even in the case where the height of the washing nozzle 473 in the stored state is low. Thereby, the height of the washing nozzle 473 in the stored state can be lower. Therefore, the height of the sanitary washing apparatus 100 can be lower; and a compact sanitary washing apparatus 100 can be realized.

According to this embodiment, the washing nozzle 473 avoids contacting the rear 600 of the user when the tip 473*a* of the washing nozzle 473 advances while tracing the straight-line path 493. Therefore, a wider washing range can be ensured. Thereby, the sanitary washing apparatus 100 according to this embodiment can execute the moving function while stabilizing the washing sensation over a wider range.

Another embodiment of the invention will now be described.

Figure 11A:
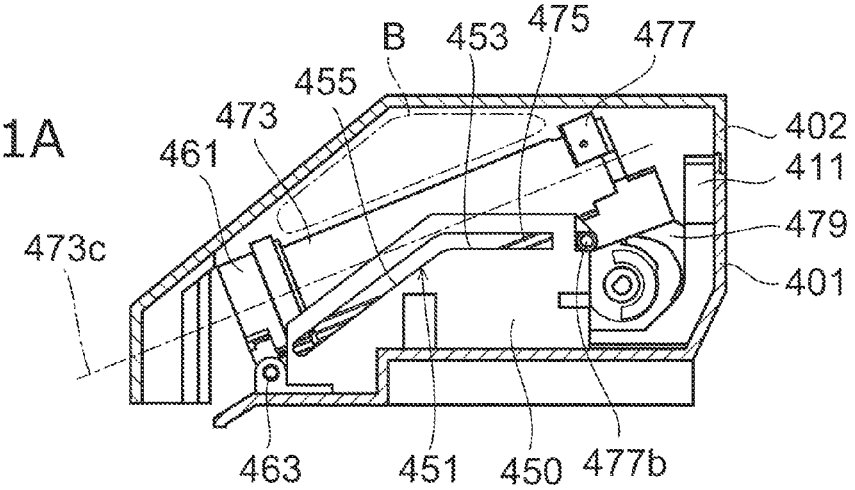
FIGS. 11A to 11C are schematic plan views illustrating the nozzle unit of this embodiment of the invention.
Figure 11B:
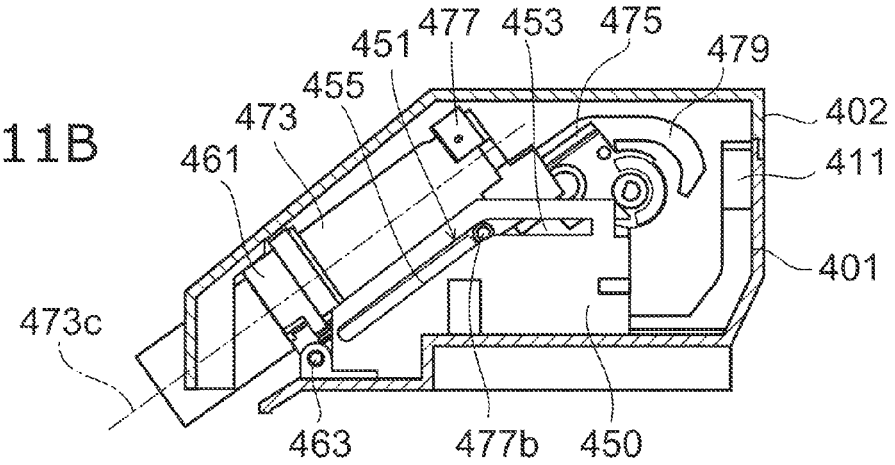
Figure 11C:
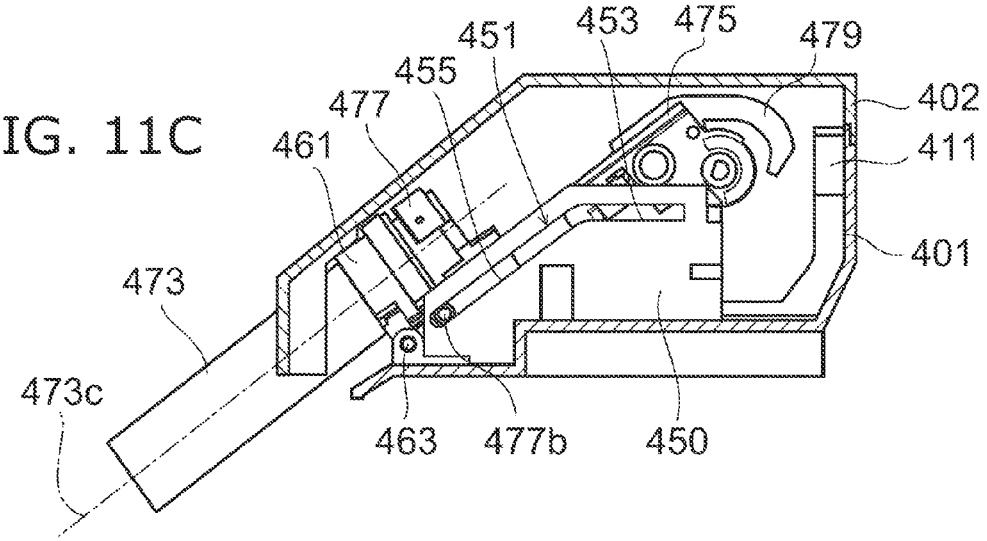

FIGS. 11A to 11C are schematic plan views illustrating the nozzle unit of this embodiment of the invention.

The nozzle motor 476 is omitted for convenience of description in the nozzle unit 470*a* illustrated in FIGS. 11A to 11C.

The washing nozzle 473 of this embodiment is a single-stage washing nozzle having only the nozzle head as a movable portion. The washing nozzle 473 is fixed to the slider 477. Otherwise, the structure is similar to the structure of the nozzle unit 470 described above in regard to FIG. 2A to FIG. 7D.

First, the engaging portion 477*b* of the slider 477 slides through the curve regulator 453 when the washing nozzle 473 starts to change from the stored state to the advanced state. At this time, the washing nozzle 473 passes through the tubular body 461 which is pivotally supported rotatably with respect to the casing 400 by the rotation shaft 463. The tubular body 461 is formed in a tubular configuration and can rotate around the rotation shaft 463 according to the angle of the washing nozzle 473.

Therefore, the engaging portion 477*b* moves in substantially the horizontal direction by being guided by the curve regulator 453 when the washing nozzle 473 starts to change from the stored state to the advanced state. On the other hand, the washing nozzle 473 passes through the interior of the tubular body 461 which rotates around the rotation shaft 463. Thereby, the washing nozzle 473 advances while transitioning to the orientation having the greater angle θ of the axis 473*c* of the washing nozzle 473 with respect to the horizontal plane 850 as illustrated in FIGS. 11A to 11C. In other words, the washing nozzle 473 advances while transitioning to the orientation that is more upright than the stored state. Therefore, the tip 473*a* of the washing nozzle 473 advances while tracing the curved path 491 (referring to FIG. 4) when the engaging portion 477*b* of the slider 477 slides through the curve regulator 453.

At this time, the slider 477 advances by tracing substantially the same path as the path groove 451 made in the path guide 450. Therefore, the upper end portion 477*a* of the slider 477 advances while tracing the substantially horizontal path 495 or the path 495 that moves frontward and downward (referring to FIG. 4) when the engaging portion 477*b* slides through the curve regulator 453. In other words, the upper end portion 477*a* of the slider 477 moves directly under the case cover 402. Therefore, the washing nozzle 473 can advance while transitioning to the orientation that is more upright than the stored state by utilizing the space B existing above the washing nozzle 473 in the stored state by the forward-advance operation of the washing nozzle 473 even in the case where the washing nozzle 473 is single-stage instead of multistage. Therefore, a special space is unnecessary for the washing nozzle 473 to transition to the orientation that is more upright than the stored state. Thereby, the height of the case cover 402 can be reduced to the maximum height of the washing nozzle 473 in the stored state. Therefore, the height of the sanitary washing apparatus 100 can be lower; and a compact sanitary washing apparatus 100 can be realized. Otherwise, effects similar to the effects described above in regard to FIG. 4 to FIG. 9 are obtained.

Continuing, the engaging portion 477*b* of the slider 477 slides through the straight-line regulator 455. At this time, the tilt angle of the straight-line regulator 455, i.e., the movement direction of the slider 477 and the washing nozzle 473, is substantially the same as the axial direction of the tubular body 461 because the tubular body 461 is pivotally supported rotatably with respect to the casing 400. Thereby, the tip 473*a* of the washing nozzle 473 advances while tracing the straight-line path 493 (referring to FIG. 4) when the engaging portion 477*b* of the slider 477 slides through the straight-line regulator 455.

According to this embodiment, the washing nozzle 473 advances while transitioning to the orientation having the greater angle θ of the axis 473*c* of the washing nozzle 473 with respect to the horizontal plane 850 even in the case where the washing nozzle 473 is single-stage instead of multistage. Therefore, the washing nozzle 473 can be stored at an orientation at which the angle θ of the axis 473*c* of the washing nozzle 473 with respect to the horizontal plane 850 is smaller than that of the advanced state. The rotation space necessary to change the angle θ of the axis 473*c* of the washing nozzle 473 with respect to the horizontal plane 850 can be minimized. Thereby, the height of the washing nozzle 473 in the stored state can be lower. Therefore, the height of the sanitary washing apparatus 100 can be lower; and a compact sanitary washing apparatus 100 can be realized. Otherwise, effects similar to the effects described above in regard to FIG. 4 to FIG. 9 are obtained.

According to this embodiment, the nozzle motor 476 displaces in conjunction with the advance of the washing nozzle 473 even in the case where the washing nozzle 473 is single-stage instead of multistage. Then, the relative positions of the base 475 and the nozzle motor 476 do not change due to the advance of the washing nozzle 473.

Thereby, the drive force transmitted from the nozzle motor 476 to the washing nozzle 473 is maintained at substantially a constant. That is, the loss of the drive force transmitted from the nozzle motor 476 to the washing nozzle 473 does not occur due to the washing nozzle 473 advancing while transitioning to the orientation that is more upright than the stored state. Alternatively, the relationship between the push-out amount of the nozzle motor 476 and the advancement amount of the washing nozzle 473 is linear like the straight line 501 illustrated in FIG. 3 when the tip 473*a* of the washing nozzle 473 advances while tracing the curved path 491 and the straight-line path 493. Therefore, the washing nozzle 473 can advance with a substantially constant drive force transmitted from the nozzle motor 476. Thereby, the washing nozzle 473 can be caused to stably advance. The washing nozzle 473 can be moved accurately to the prescribed position in the case where the user adjusts the position of the washing nozzle 473.

Another embodiment of the invention will now be described.

FIGS. 12A to 12D are schematic plan views illustrating the nozzle unit of this embodiment of the invention. The nozzle motor 476 is omitted for convenience of description in the nozzle unit 470*b* illustrated in FIGS. 12A to 12D.

The structure of the nozzle unit 470*b* illustrated in FIGS. 12A to 12D is similar to the structure of the nozzle unit 470 described above in regard to FIG. 2A to FIG. 10F. In this embodiment, the advancement order of the nozzle head 471 and the cylinder 472 is different from the advancement order of the nozzle head 471 and the cylinder 472 of the nozzle unit 470 described above in regard to FIG. 2A to FIG. 10F.

Figure 12A:
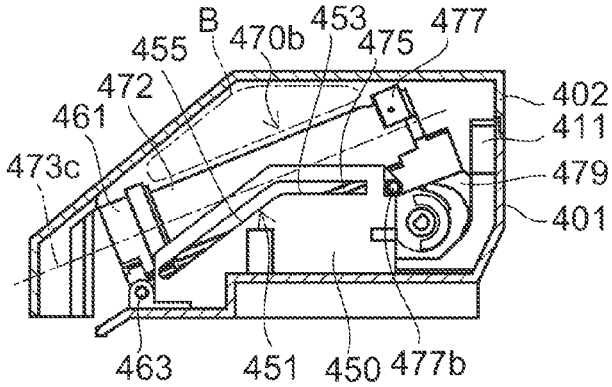
FIGS. 12A to 12D are schematic plan views illustrating the nozzle unit of this embodiment of the invention.
Figure 12B:
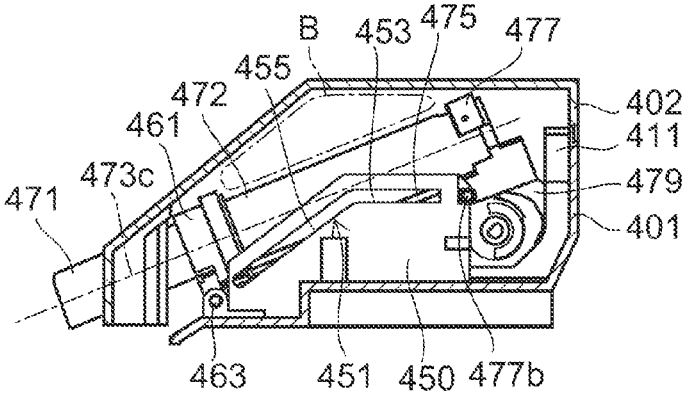

As illustrated in FIG. 12A and FIG. 12B, first, the nozzle head 471 passes through the interior of the tubular body 461 by sliding out of the cylinder 472 in the state in which the slider 477 and the cylinder 472 are stopped. At this time, the tip 473*a* of the washing nozzle 473 advances while tracing the straight-line path 493 (e.g., referring to FIG. 4) because the nozzle head 471 passes through the interior of the tubular body 461 by sliding through the interior of the cylinder 472.

Figure 12C:
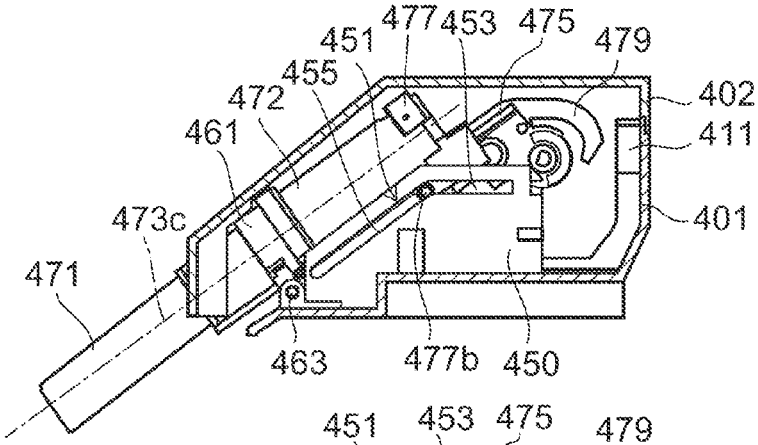

Continuing as illustrated in FIG. 12C, the engaging portion 477*b* of the slider 477 slides through the curve regulator 453. At this time, as described above in regard to FIG. 4 to FIG. 7D, the washing nozzle 473 advances while transitioning to the orientation having the greater angle θ of the axis 473*c* of the washing nozzle 473 with respect to the horizontal plane 850. In other words, the washing nozzle 473 advances while transitioning to the orientation that is more upright than the stored state. Therefore, the tip 473*a* of the washing nozzle 473 advances while tracing the curved path 491 (e.g., referring to FIG. 4).

Figure 12D:
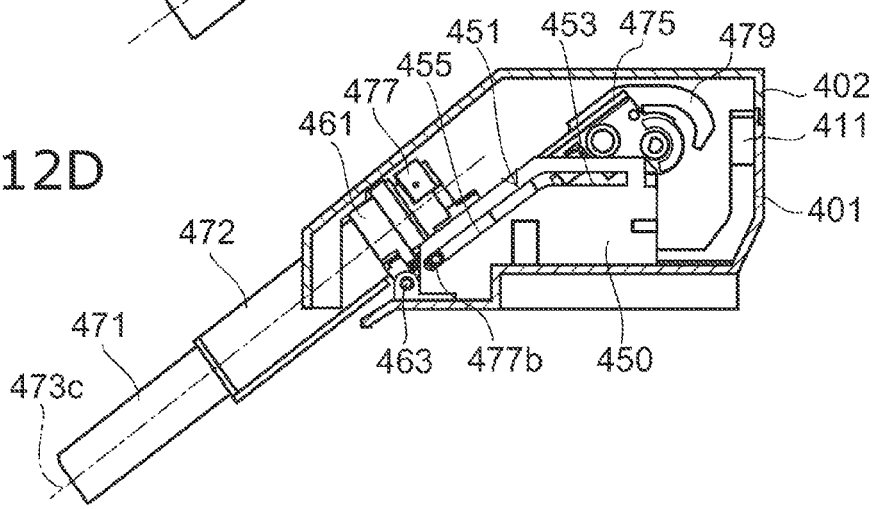

Continuing as illustrated in FIG. 12D, the engaging portion 477*b* of the slider 477 slides through the straight-line regulator 455. At this time, as described above in regard to FIG. 4 to FIG. 7D, the tilt angle of the straight-line regulator 455, i.e., the movement direction of the slider 477 and the cylinder 472, is substantially the same as the axial direction of the tubular body 461 because the tubular body 461 is pivotally supported rotatably with respect to the casing 400. Thereby, the tip 473*a* of the washing nozzle 473 advances while tracing the straight-line path 493.

Thus, the tip 473*a* of the washing nozzle 473 of this embodiment traces the straight-line path 493, subsequently traces the curved path 491, and finally traces the straight-line path 493. In this embodiment, the straight-line path 493 traced by the tip 473*a* of the washing nozzle 473 when the nozzle head slides out of the cylinder 472 in the state in which the slider 477 and the cylinder 472 are stopped is a path to cause the washing nozzle 473 to advance to approach the rear 600 of the user seated on the toilet seat 200. The curved path 491 traced by the tip 473*a* of the washing nozzle 473 is a path to cause the washing nozzle 473 to avoid contacting the rear 600 of the user seated on the toilet seat 200. The straight-line path 493 (the final straight-line path 493) traced by the tip 473*a* of the washing nozzle 473 when the engaging portion 477*b* of the slider 477 slides through the straight-line regulator 455 is a path to cause the washing nozzle 473 to reach the advanced state.

Because the nozzle head 471 advances first and then the cylinder 472 advances according to this embodiment, the configuration or the structure of the nozzle unit 470*b* can be simpler when considering the operation of the multistage washing nozzle, the body wash of the multistage washing nozzle (the wash of the outer circumferential surfaces of the nozzle head 471 and the cylinder 472), the washing of the water discharge port 474, etc. Because the straight-line path 493 corresponds to the final portion of the path of the tip 473*a* of the washing nozzle 473, the washing sensation due to the wash water squirted from the washing nozzle 473 can be stabilized even in the case where the moving function is used as described above.

Similarly to the operation of the washing nozzle 473 illustrated in FIGS. 6A to 6C, the washing nozzle 473 advances while transitioning to the orientation having the greater angle θ of the axis 473*c* of the washing nozzle 473 with respect to the horizontal plane 850. Therefore, the height of the sanitary washing apparatus 100 can be lower; and a compact sanitary washing apparatus 100 can be realized.

Another embodiment of the invention will now be described.

Figure 13A:
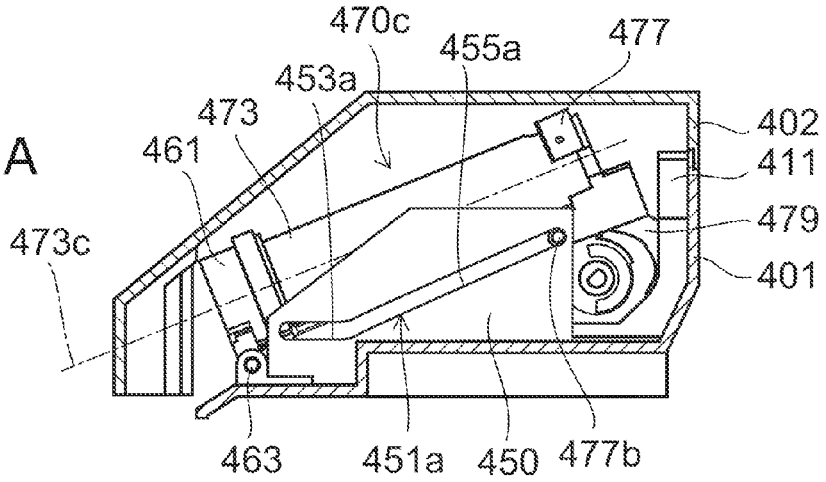
FIGS. 13A to 13C are schematic plan views illustrating the nozzle unit of this embodiment of the invention.
Figure 13B:
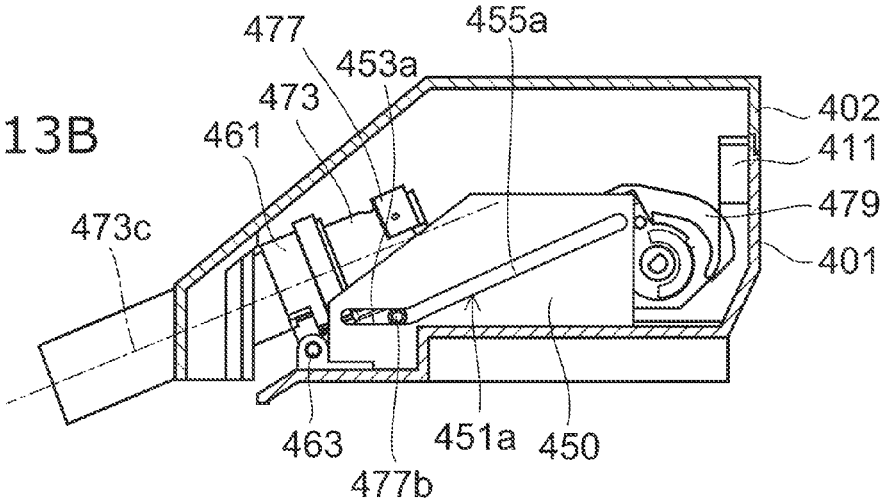
Figure 13C:
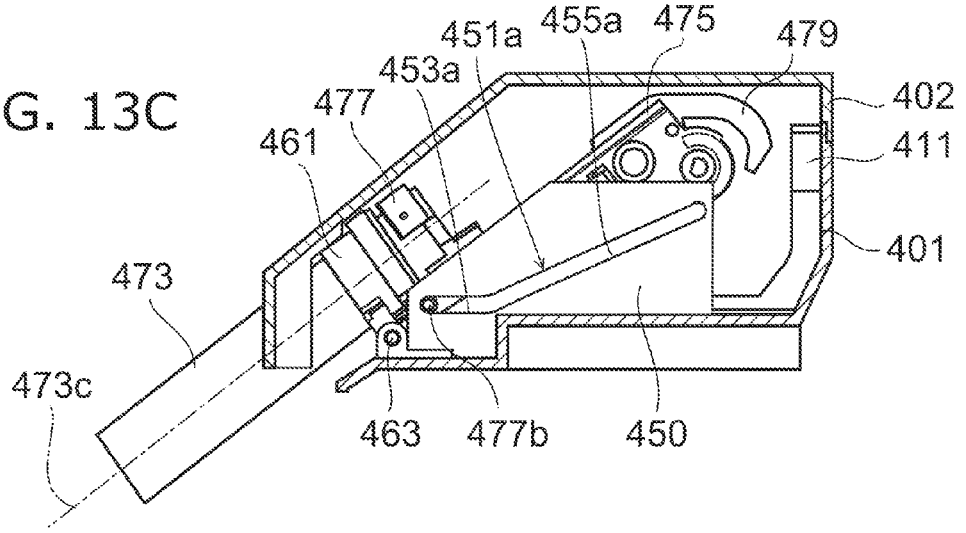

FIGS. 13A to 13C are schematic plan views illustrating the nozzle unit of this embodiment of the invention. The nozzle motor 476 is omitted for convenience of description in the nozzle unit 470*c* illustrated in FIGS. 13A to 13C.

A path groove 451*a* that is configured to regulate the path of the washing nozzle 473 is made in the path guide 450 provided in the casing 400 of this embodiment. The path guide 450 includes a curve regulator 453*a* and a straight-line regulator (an angle regulator) 455*a*.

The curve regulator 453*a* is formed in substantially the horizontal direction. On the other hand, the straight-line regulator 455*a* is made to be tilted such that one end portion on the side connected to the curve regulator 453*a* is lower than the other end portion on the side not connected to the curve regulator 453*a*. In other words, the straight-line regulator 455*a* is made to be tilted such that the other end portion on the side not connected to the curve regulator 453*a* is higher than the one end portion on the side connected to the curve regulator 453*a*.

That is, in this embodiment, the arrangement between the straight-line regulator 455*a* and the curve regulator 453*a* is different from the arrangement between the straight-line regulator 455 and the curve regulator 453 described above in regard to FIG. 2A to FIG. 12D. In the path groove 451 described above in regard to FIG. 2A to FIG. 12D, the engaging portion 477*b* of the slider 477 first slides through the curve regulator 453 and then slides through the straight-line regulator 455 when the washing nozzle 473 advances. Conversely, in this embodiment, the engaging portion 477*b* of the slider 477 first slides through the straight-line regulator 455*a* and then slides through the curve regulator 453*a* when the washing nozzle 473 advances.

Otherwise, the structure of the nozzle unit 470*c* is similar to the structure of the nozzle unit 470 described above in regard to FIG. 2A to FIG. 10F. The straight-line regulator 455*a* may have a lock mechanism; and a driving unit for modifying the angle may be provided.

First, the engaging portion 477*b* of the slider 477 slides through the straight-line regulator 455*a* as illustrated in FIG. 13A and FIG. 13B when the washing nozzle 473 starts to change from the stored state to the advanced state. At this time, the tilt angle of the straight-line regulator 455*a*, i.e., the movement direction of the slider 477 and the cylinder 472, is substantially the same as the axial direction of the tubular body 461 because the tubular body 461 is pivotally supported rotatably with respect to the casing 400. Thereby, the tip 473*a* of the washing nozzle 473 advances while tracing the straight-line path 493 (e.g., referring to FIG. 4) when the engaging portion 477*b* of the slider 477 slides through the straight-line regulator 455*a*.

Continuing, the engaging portion 477*b* of the slider 477 slides through the curve regulator 453*a*. At this time, the cylinder 472 passes through the tubular body 461 which is pivotally supported rotatably with respect to the casing 400 by the rotation shaft 463. As described above, the tubular body 461 is formed in a tubular configuration and can rotate around the rotation shaft 463 according to the angle of the cylinder 472. Then, the tubular body 461 and the rotation shaft 463 can guide and regulate the movement of the washing nozzle 473.

Therefore, the engaging portion 477*b* moves in substantially the horizontal direction by being guided by the curve regulator 453*a*. On the other hand, the cylinder 472 passes through the interior of the tubular body 461 which rotates around the rotation shaft 463. Thereby, the washing nozzle 473 advances while transitioning to the orientation having the greater angle θ of the axis 473*c* of the washing nozzle 473 with respect to the horizontal plane 850. In other words, the washing nozzle 473 advances while transitioning to the orientation that is more upright than the stored state. Therefore, the tip 473*a* of the washing nozzle 473 advances while tracing the curved path 491 (e.g., referring to FIG. 4) when the engaging portion 477*b* of the slider 477 slides through the curve regulator 453.

Thus, the tip 473*a* of the washing nozzle 473 of this embodiment traces through the straight-line path 493 and subsequently traces through the curved path 491. In this embodiment, the straight-line path 493 traced by the tip 473*a* of the washing nozzle 473 is a path to cause the washing nozzle 473 to advance to approach the rear 600 of the user seated on the toilet seat 200. On the other hand, the curved path 491 traced by the tip 473*a* of the washing nozzle 473 is a path to cause the washing nozzle 473 to reach the advanced state by avoiding contact with the rear 600 of the user seated on the toilet seat 200. That is, the curved path 491 corresponds to the final portion of the path of the tip 473*a* of the washing nozzle 473.

According to this embodiment, the tip 473*a* of the washing nozzle 473 traces the curved path 491 after tracing the straight-line path 493. Therefore, the distance between the casing 400 and the rear end portion of the washing nozzle 473 or the upper end portion 477*a* of the slider 477 when the tip 473*a* of the washing nozzle 473 traces the curved path 491 is longer than that of the case where the tip 473*a* of the washing nozzle 473 traces the curved path 491 prior to tracing the straight-line path 493. Therefore, the tip 473*a* of the washing nozzle 473 can trace a longer curved path. Thereby, the height of the washing nozzle 473 in the stored state can be even lower. Therefore, the height of the sanitary washing apparatus 100 can be even lower; and a more compact sanitary washing apparatus 100 can be realized.

As illustrated in FIGS. 13A to 13C, the length of the straight-line regulator 455*a* is longer than the length of the curve regulator 453*a*. Therefore, the length of the straight-line path 493 is longer than the length of the curved path 491. Thereby, a longer distance between the casing 400 and the rear end portion of the washing nozzle 473 or the upper end portion 477*a* of the slider 477 can be ensured by the tip 473*a* of the washing nozzle 473 tracing the straight-line path 493. Therefore, a larger space can be ensured when the tip 473*a* of the washing nozzle 473 traces the curved path 491. Therefore, the height of the sanitary washing apparatus 100 can be even lower; and a more compact sanitary washing apparatus 100 can be realized.

Hereinabove, the case where the washing nozzle 473 changes from the stored state to the advanced state is mainly described. However, when changing from the advanced state to the stored state, the washing nozzle 473 moves while tracing a similar path. In other words, for example, the tip 473*a* of the washing nozzle 473 traces the curved path 491 after the straight-line path 493 when the washing nozzle 473 changes from the advanced state to the stored state. Alternatively, the tip 473*a* of the washing nozzle 473 traces the straight-line path 493, subsequently traces the curved path 491, and finally traces the straight-line path 493. Alternatively, the tip 473*a* of the washing nozzle 473 traces the straight-line path 493 after tracing the curved path 491. That is, the washing nozzle 473 retreats while transitioning to the orientation having the smaller angle θ of the axis 473*c* of the washing nozzle 473 with respect to the horizontal plane 850. Then, the washing nozzle 473 is stored at the orientation at which the angle θ of the axis 473*c* of the washing nozzle 473 with respect to the horizontal plane 850 is smaller than that of the advanced state.

Hereinabove, embodiments of the invention are described. However, the invention is not limited to these descriptions. Appropriate design modifications made by one skilled in the art in regard to the embodiments described above also are within the scope of the invention to the extent that the features of the invention are included. For example, the configurations, the dimensions, the material qualities, the dispositions, etc., of the components included in the nozzle unit 470, the path guide 450, etc., and the disposition methods, etc., of the washing nozzle 473 and the nozzle motor 476 are not limited to those illustrated may be modified appropriately. For example, the nozzle motor 476 may be provided by being divided into a motor to change the angle of the washing nozzle 473 and a motor to advance the washing nozzle 473. The components included in the embodiments described above can be combined within the extent of technical feasibility; and such combinations are included in the scope of the invention to the extent that the features of the invention are included.

What is claimed is:

1. A sanitary washing apparatus, comprising:

a washing nozzle having a water discharge port, the washing nozzle being configured to wash a body of a user by squirting water from the water discharge port; and a casing capable of storing the washing nozzle, the washing nozzle being configured to change from a stored state to an advanced state while transitioning to an orientation in that an angle of an axis of the washing nozzle with respect to a horizontal plane in the advanced state is greater than the angle of the axis of the washing nozzle in the stored state, the washing nozzle being stored in the casing in the stored state, the washing nozzle being configured to wash the body in the advanced state, the angle of the axis of the washing nozzle in the stored state being an angle configured to cause the washing nozzle to contact a rear of the user in the case where the washing nozzle advances at the angle of the axis of the washing nozzle in the stored state from a position of the stored state, the washing nozzle being capable of avoiding contact with the rear of the user by advancing while transitioning to the orientation.

2. The apparatus according to claim 1, wherein a path traced by a tip of the washing nozzle includes:

a curved path to cause the washing nozzle to avoid contacting the rear of the user; and a straight-line path to cause the washing nozzle to reach the advanced state.

3. The apparatus according to claim 1, wherein a path traced by a tip of the washing nozzle includes:

a straight-line path to cause the washing nozzle to advance to approach the rear of the user; and a curved path to cause the washing nozzle to avoid contacting the rear of the user and reach the advanced state.

4. The apparatus according to claim 2, wherein a length of the straight-line path is longer than a length of the curved path.

5. The apparatus according to claim 1, further comprising a path guide configured to guide the movement of the washing nozzle, the washing nozzle changing from the stored state to the advanced state while tracing a constant path due to the path guide.

6. The apparatus according to claim 5, wherein the path guide includes an angle regulator configured to regulate an angle of a straight-line path with respect to the horizontal plane, the straight-line path causing the washing nozzle to reach the advanced state.

7. The apparatus according to claim 5, wherein the path guide includes an angle regulator configured to regulate an angle of a straight-line path with respect to the horizontal plane, the straight-line path causing the washing nozzle to advance to approach the rear of the user.

8. The apparatus according to claim 6, wherein:

the path guide includes a path groove configured to regulate the path of the washing nozzle; and the washing nozzle includes an engaging portion capable of engaging the path groove, and the washing nozzle moves in the constant path by the engaging portion moving while sliding in the path groove.

9. The apparatus according to claim 8, wherein:

the engaging portion is provided on a rear end portion side of the washing nozzle; and the path guide is disposed and fixed inside the casing.

10. The apparatus according to claim 1, wherein the washing nozzle transitions to the orientation having the greater angle by utilizing a space existing above the washing nozzle in the stored state by a forward-advance operation of the washing nozzle when the washing nozzle changes from the stored state to the advanced state.

11. The apparatus according to claim 10, wherein a movement amount of a tip of the washing nozzle is smaller than a movement amount of a rear end portion of the washing nozzle when the washing nozzle transitions to the orientation having the greater angle.

12. The apparatus according to claim 10, further comprising a rotation shaft configured to guide and regulate the movement of the washing nozzle when the washing nozzle transitions to the orientation having the greater angle, the rotation shaft being provided in the casing.

13. The apparatus according to claim 12, wherein the rotation shaft is provided on a tip side of the washing nozzle in the stored state.

14. The apparatus according to claim 10, further comprising a rotation shaft configured to guide and regulate the movement of the washing nozzle when the washing nozzle transitions to the orientation having the greater angle, the rotation shaft being provided in the washing nozzle.

15. The apparatus according to claim 10, wherein an upper end portion of the washing nozzle traces a horizontal path parallel to the horizontal plane or a path moving frontward and downward when the washing nozzle transitions to the orientation having the greater angle.

16. The apparatus according to claim 10, further comprising:

a drive unit configured to cause the washing nozzle to advance and retreat from the casing; and a transmission unit configured to transmit a drive force of the drive unit to the washing nozzle, the drive unit being configured to displace in conjunction with the movement of the washing nozzle.

17. The apparatus according to claim 1, further comprising:

a drive unit configured to cause the washing nozzle to advance and retreat from the casing; and a transmission unit configured to transmit a drive force of the drive unit to the washing nozzle, a relationship between a push-out amount of the drive unit and an advancement amount of the washing nozzle being linear.

18. The apparatus according to claim 17, wherein the drive unit displaces in conjunction with the movement of the washing nozzle.

19. The apparatus according to claim 17, wherein:

a path traced by a tip of the washing nozzle when the washing nozzle changes from the stored state to the advanced state includes a curved path traced when transitioning to the orientation having the greater angle, and a straight-line path traced when the angle is constant; and a change amount of the angle of the axis of the washing nozzle with respect to the horizontal plane is the same as a change amount of an angle of the drive unit with respect to the horizontal plane when the tip traces the curved path.

20. The apparatus according to claim 17, wherein the drive unit is disposed on a rear end side of the washing nozzle and is configured to displace upward and downward in conjunction with the movement of the washing nozzle.

21. The apparatus according to claim 17, further comprising a base configured to slidably support the washing nozzle, the base being linked to the movement of the washing nozzle, the drive unit being fixed to the base.

22. The apparatus according to claim 17, wherein the washing nozzle is a multistage washing nozzle including a plurality of movable portions.

23. The apparatus according to claim 22, wherein:

the multistage washing nozzle includes a nozzle head, the water discharge port being provided in the nozzle head, and at least one cylinder capable of storing at least a portion of the nozzle head; and the multistage washing nozzle changes from the stored state while transitioning to the orientation in the state of the nozzle head being stored inside the at least one cylinder, and the multistage washing nozzle subsequently changes to the advanced state with the angle in a constant state while the nozzle head slides out of the at least one cylinder.

* * * * *